US009063443B2

(12) United States Patent
Ishigami et al.

(10) Patent No.: US 9,063,443 B2
(45) Date of Patent: Jun. 23, 2015

(54) MAGNETIC CARRIER AND TWO-COMPONENT DEVELOPER

(71) Applicant: CANON KABUSHIKI KAISHA, Tokyo (JP)

(72) Inventors: Koh Ishigami, Abiko (JP); Kentaro Kamae, Kashiwa (JP); Nozomu Komatsu, Toride (JP); Yoshinobu Baba, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 139 days.

(21) Appl. No.: 13/901,250

(22) Filed: May 23, 2013

(65) Prior Publication Data

US 2013/0316282 A1 Nov. 28, 2013

(30) Foreign Application Priority Data

May 28, 2012 (JP) ..... 2012-121362

(51) Int. Cl.
*G03G 9/107* (2006.01)
*G03G 9/113* (2006.01)
*G03G 9/083* (2006.01)

(52) U.S. Cl.
CPC ..... *G03G 9/0833* (2013.01); *G03G 9/1075* (2013.01); *G03G 9/107* (2013.01); *G03G 9/1131* (2013.01); *G03G 9/1133* (2013.01)

(58) Field of Classification Search
CPC .. G03G 9/1075; G03G 9/1133; G03G 9/1131
USPC ..... 430/111.33, 111.32, 111.31
See application file for complete search history.

(56) References Cited

U.S. PATENT DOCUMENTS 5,340,677 A 8/1994 Baba et al.
5,439,771 A 8/1995 Baba et al.
5,464,720 A 11/1995 Baba et al.
5,470,687 A 11/1995 Mayama et al.
5,494,770 A 2/1996 Baba et al.
5,573,880 A 11/1996 Mayama et al.
5,576,133 A 11/1996 Baba et al.
5,712,069 A 1/1998 Baba et al.
5,744,278 A 4/1998 Ayaki et al.
5,766,814 A 6/1998 Baba et al.
5,789,132 A 8/1998 Mayama et al.
5,985,502 A 11/1999 Ayaki et al.
6,010,811 A 1/2000 Baba et al.
6,083,655 A 7/2000 Itabashi et al.
6,106,990 A 8/2000 Tazawa et al.
6,124,070 A 9/2000 Baba et al.
6,159,648 A 12/2000 Baba et al.
6,165,663 A 12/2000 Baba et al.
6,358,658 B1 3/2002 Tazawa et al.
6,566,028 B2 5/2003 Tazawa et al.
6,751,424 B2 6/2004 Komatsu et al.
6,808,852 B2 10/2004 Hotta et al.
6,905,808 B2 6/2005 Itakura et al.
7,022,449 B2 4/2006 Sugahara et al.
7,112,395 B2 9/2006 Ida et al.
7,138,213 B2 11/2006 Itakura et al.
7,144,668 B2 12/2006 Baba et al.
7,229,727 B2 6/2007 Itakura et al.
7,244,539 B2 7/2007 Baba et al.
7,279,262 B2 10/2007 Fujikawa et al.
7,288,348 B2 10/2007 Hayami et al.
7,300,733 B2 11/2007 Sugahara et al.
7,361,441 B2 4/2008 Itakura et al.
7,396,626 B2 7/2008 Fujikawa et al.
7,396,629 B2 7/2008 Baba et al.
7,452,647 B2 11/2008 Hayami et al.
7,611,813 B2 11/2009 Ida et al.
7,629,100 B2 12/2009 Okamoto et al.
7,767,370 B2 8/2010 Ishigami et al.
7,858,283 B2 12/2010 Ishigami et al.
7,906,262 B2 3/2011 Ishigami et al.
7,927,775 B2 4/2011 Komatsu et al.
7,939,233 B2 5/2011 Inoue et al.
8,084,174 B2 12/2011 Hasegawa et al.
8,114,562 B2 2/2012 Ishigami et al.
8,137,886 B2 3/2012 Baba et al.
8,142,972 B2 3/2012 Hotta et al.

(Continued)

FOREIGN PATENT DOCUMENTS

JP 2011-43738 A 3/2011
JP 2011-164225 A 8/2011

OTHER PUBLICATIONS

Shiotari, et al., U.S. Appl. No. 13/995,499, 371(c) date: Jun. 18, 2013.
Komatsu, et al., U.S. Appl. No. 13/902,365, filed May 24, 2013.
Naka, et al., U.S. Appl. No. 13/952,252, filed Jul. 26, 2013.
Hashimoto, et al., U.S. Appl. No. 13/867,398, filed Apr. 22, 2013.
Baba, et al., U.S. Appl. No. 13/961,593, filed Aug. 7, 2013.

*Primary Examiner* — Janis L Dote

(74) *Attorney, Agent, or Firm* — Fitzpatrick, Cella, Harper & Scinto

(57) ABSTRACT

The present invention provides a magnetic carrier that can stably impart charge to a toner on a long term basis and that exhibits an excellent toner separation property and thus exhibits an excellent developing performance. This magnetic carrier is a magnetic carrier in which a vinyl resin coats the surface of a resin-filled core in which a resin is filled in pores of a porous ferrite particle, wherein the resistivity, Mg content, and total content of Sr and Ca oxides of the porous ferrite particle exhibit prescribed values and the magnetic carrier has a total area—in the backscattered electron projection image obtained by observation using a scanning electron microscope at an acceleration voltage of 2.0 kV—for a region originating with the porous ferrite particle of from at least 0.2 area % to not more than 5.0 area % with reference to the projected area of the magnetic carrier.

10 Claims, 5 Drawing Sheets

(56) References Cited

U.S. PATENT DOCUMENTS

| | | | | |
|---|---|---|---|---|
| 8,288,069 | B2 | 10/2012 | Fujikawa et al. | |
| 8,298,742 | B2 | 10/2012 | Okamoto et al. | |
| 8,323,726 | B2 | 12/2012 | Naka et al. | |
| 8,475,988 | B2 | 7/2013 | Sugiura et al. | |
| 2010/0183971 | A1 | 7/2010 | Fujikawa et al. | |
| 2010/0248126 | A1 | 9/2010 | Ishigami et al. | |
| 2010/0273103 | A1 | 10/2010 | Baba et al. | |
| 2010/0310978 | A1 | 12/2010 | Endo et al. | |
| 2011/0045399 | A1 | 2/2011 | Shoji et al. | |
| 2011/0097661 | A1 | 4/2011 | Ishigami et al. | |
| 2012/0214097 | A1 | 8/2012 | Naka et al. | |
| 2013/0052580 | A1* | 2/2013 | Horie et al. | 430/123.58 |
| 2013/0171556 | A1 | 7/2013 | Fujikawa et al. | |
| 2013/0196265 | A1 | 8/2013 | Kamae et al. | |
| 2013/0244159 | A1 | 9/2013 | Ishigami et al. | |
| 2013/0244164 | A1 | 9/2013 | Fujikawa et al. | |
| 2013/0316282 | A1* | 11/2013 | Ishigami et al. | 430/111.33 |

* cited by examiner

MAGNETIC CARRIER AND TWO-COMPONENT DEVELOPER

BACKGROUND OF THE INVENTION

1. Field of the Invention

The present invention relates to a magnetic carrier and a two-component developer that are used in an electrophotographic method and an electrostatic recording method.

2. Description of the Related Art

The developing systems used in electrophotography include monocomponent developing systems, which use only toner, and two-component developing systems, which use a mixture of toner with a magnetic carrier. The two-component developers used in two-component developing systems provide a high opportunity for contact between the toner and the magnetic carrier, which is the charge-providing member, and provide stable triboelectric charge characteristics and thus offer the advantage of maintaining a high image quality. In addition, they are used in particular in high-speed machines because the magnetic carrier also feeds a large amount of toner to the development segment and because control is easily performed. The magnetic carrier is typically a resin-coated carrier in which a resin is coated on a magnetic core material, e.g., ferrite, and a variety of proposals have been made with regard to the core material, coating resin, additives, and so forth.

In Japanese Patent Application Laid-open No. 2011-43738, a magnetic carrier is proposed that uses a magnesium ferrite containing a very small amount of Mn for the core material. While having the magnetization and resistance coexist in balance is problematic with a magnesium ferrite, by adding a very small amount of Mn to the magnesium ferrite the structure of the crystal grains is made nonuniform and the crystal boundary is made discontinuous, which brings about a balanced coexistence of the magnetization with the resistance. However, because the crystal grains are made nonuniform, the mechanical strength of the core is then deficient and the carrier particles can undergo cracking and chipping when subjected to stress in the developing device. The thusly produced cracked and chipped particles fly over to the photosensitive member and, under the effect of the pressure applied in the transfer step and cleaning step, these cracked and chipped particles gouge into the photosensitive member and negative effects on the image may then be produced.

In Japanese Patent Application Laid-open No. 2011-164225, a resin-filled magnetic carrier is proposed in which a porous magnesium ferrite containing a very small amount of Sr is used for the core material and a resin is filled and coated in the pores of the ferrite. This resin-filled magnetic carrier then takes the form of a reduced specific gravity carrier that uses a porous magnesium ferrite particle for the core material, and the stress applied to the developer is reduced and a higher quality image can be obtained longer than for a conventional ferrite carrier. In addition, the addition of the Sr results in an inhibition of the variance in magnetization among core particles and also facilitates control of the pore volume in the core. However, the magnesium ferrite constituting the core has a very low resistance, and as a consequence a charge leakage-induced disturbance of the latent image and generation of white spots on the image may occur. While the charge leakage can be avoided by carrying out development at a lower field strength, the force that causes toner flight is then also weakened and an adequate amount of toner may not take flight and the necessary image density may also not be obtained. Moreover, since the silicone resin that is the coating resin is easily sliced off, the resistance of the magnetic carrier can undergo a sharp decline and in particular the toner may not be adequately charged in a high-temperature, high-humidity environment and negative effects on the image, for example, fogging, may also occur. In addition, the admixture of the sliced-off silicone resin into the toner can also cause impaired fixing of the toner and can cause unevenness in the gloss of the image post-fixing.

While methods for improving the stress resistance and stability of two-component developers have been investigated as noted above, the appearance is still desired of a two-component developer that exhibits a very durable stability and that can provide a high-quality image free of image defects on an extended basis.

SUMMARY OF THE INVENTION

The present invention provides a magnetic carrier and a two-component developer that solve the problems described above. That is, the present invention provides a magnetic carrier that can stably impart charge to a toner on an extended basis and that exhibits an excellent toner separation property from the magnetic carrier and that thus exhibits an excellent developing performance.

The present invention relates to a magnetic carrier of which a resin-filled core is coated with a vinyl-resin, the resin-filled core having a porous ferrite particle in pores of which a resin is filled, wherein the porous ferrite particle i) has a resistivity at 100 V/cm of from at least $8.0\times10^4$ Ω·cm to not more than $5.0\times10^6$ Ω·cm, ii) contains an oxide of Mg in the range from at least 1.00 mass % to not more than 15.00 mass % as MgO with reference to the mass of the porous ferrite particle, and iii) contains an oxide of Sr and an oxide of Ca, with a total content of these oxides being from at least 0.20 mass % to not more than 3.00 mass % as SrO and CaO with reference to the mass of the porous ferrite particle, and wherein in a backscattered electron projection image of the magnetic carrier obtained by using a scanning electron microscope at an acceleration voltage of 2.0 kV, the magnetic carrier has a total area for regions originating with the porous ferrite particle of from at least 0.2 area % to not more than 5.0 area % with reference to the projected area of the magnetic carrier.

The present invention can provide a magnetic carrier that can stably impart charge to a toner on a long term basis and that exhibits an excellent toner separation and that thus exhibits an excellent developing performance.

BRIEF DESCRIPTION OF THE DRAWINGS

FIG. 4 is a set of schematic cross-sectional diagrams of an apparatus for measuring the resistivity of, e.g., the porous ferrite particle, wherein

DESCRIPTION OF THE PREFERRED EMBODIMENTS

Figure 1B:
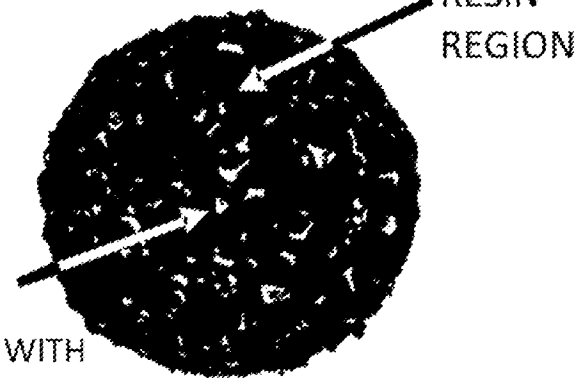
FIG. 1B is a schematic diagram of the surface state of the magnetic carrier.

Embodiments of the present invention are described in detail in the following.

The magnetic carrier of the present invention has a resistance and strength that are controlled at the magnetic carrier level by the porosification of a magnesium ferrite that contains magnesium oxide at from at least 1.00 mass % to not more than 15.00 mass % as MgO and by filling with a resin. In addition, by incorporating an oxide of Sr and an oxide of Ca in the porous magnesium ferrite particle used by the present invention, breakdown is inhibited while having a low-resistance core and the charge leakage-induced disturbance of the latent image and appearance of white spots on the image, which have been problems associated with the use of magnesium ferrite as a carrier, are inhibited. Moreover, the proportion of the area of the region originating with the porous ferrite particle in the magnetic carrier particle surface is stipulated for the magnetic carrier of the present invention. This region originating with the porous ferrite particle is the high-brightness (clearly seen in the image in white) region in the projection image that visualizes the backscattered electrons (FIG. 1) and provided using a scanning electron microscope at a prescribed acceleration voltage.

This indicates the porous ferrite particle region that is observed as exposed at the magnetic carrier particle surface (i.e., in an exposed state or in a state coated by a very thin coat layer). By bringing the magnetic carrier into the previously indicated surface state in the present invention, the characteristics of the low-resistance magnesium ferrite that are advantageous for the developing performance are maintained at the magnetic carrier particle surface. Moreover, the magnetic carrier of the present invention has the coated resin region necessary for providing charge and is a magnetic carrier for which changes in the surface properties of the magnetic carrier are inhibited—even during extended use.

While the reasons are unclear as to why the magnetic carrier of the present invention exhibits the excellent effects described above, the present inventors hold as follows.

A trade-off relationship generally obtains between the magnetization and resistance in the case of magnesium ferrites, and the resistance value thus suffers from a very substantial decline when the intensity of magnetization necessary in the developing step is secured. When, in order to raise the resistance value, a magnesium ferrite was coated with a large amount of resin, partial reduction in the resistance could not be avoided after extended use due to resin debonding—even when the resistance was initially adjusted to a suitable value using the resin coating. As a consequence, the environmental characteristics were impaired due to the lower resistance and image problems associated with charge leakage were induced.

The present invention comprises a low specific gravity carrier in which a resin is filled into a porous magnesium ferrite that has pores that penetrate into the interior of the particle: the stress applied to the magnetic carrier by stirring in the developing device is thus reduced and stable characteristics can be exhibited on an extended basis. The stress applied to the coating resin is mitigated by the use of the low specific gravity carrier that uses a porous magnesium ferrite particle.

However, magnesium ferrite itself has a low resistance and the possibility thus remains of the occurrence of image problems associated with charge leakage. Due to this, charge leakage must be inhibited at the core level. In the present invention, breakdown of the ferrite core itself is inhibited by the incorporation in the magnesium ferrite of small amounts of an oxide of Sr and an oxide of Ca.

The interior of the porous magnesium ferrite particles has a structure in which magnesium ferrite grains are present with grain boundaries, and a portion of the Sr and Ca oxides does not undergo solid dissolution in the magnesium ferrite fraction and is localized at the grain boundaries of the grains and at the particle surface. It is hypothesized that, as a result of this localization of the Sr and Ca oxides at the grain boundaries of the grains and at the particle surface, the resistance of the grain boundaries and particle surface is raised and breakdown at the ferrite particle level is thus inhibited. The internal structure of the ferrite particles was checked by processing the ferrite particle cross section and then analyzing the cross section.

Here, an adequate increase in the resistance is not seen from just the addition of only Sr oxide or only Ca oxide. It is thought that the resistance to charge leakage is improved when Sr oxide and Ca oxide are simultaneously added and that, in order to obtain this result, the addition of Sr oxide and Ca oxide is required.

In addition, it was discovered that the cracking and chipping of the magnetic carrier is inhibited by the addition of the Sr oxide and Ca oxide and causing them to be present at the grain boundaries of the grains and at the core surface. It is hypothesized that the magnesium ferrite sintered particles are more tightly sintered to each other through the Sr oxide and Ca oxide and that cracking and chipping at the magnetic carrier level is thereby inhibited.

The porous ferrite particle used in the magnetic carrier of the present invention has a resistivity at 100 V/cm of from at least $8.0\times10^4$ Ω·cm to not more than $5.0\times10^6$ Ω·cm. From at least $2.0\times10^5$ Ω·cm to not more than $1.0\times10^6$ Ω·cm is preferred. When the porous ferrite particle has a resistivity at 100 V/cm of from at least $8.0\times10^4$ Ω·cm to not more than $5.0\times10^6$ Ω·cm, charge leakage can be stopped and the developing performance can be improved. In addition to the improved developing performance, the image defect known as blank dots can also be more thoroughly inhibited.

The resistivity of this porous ferrite particle at 100 V/cm can be adjusted into the range referenced above through the total content of the Sr oxide and Ca oxide and through the sintering conditions in the porous ferrite particle production step, vide infra, and particularly through the main sintering temperature and time and through adjustment of the oxygen concentration in the sintering atmosphere.

When the resistivity of the ferrite particle is reduced to the range of from at least $8.0\times10^4$ Ω·cm to not more than $5.0\times10^6$ Ω·cm, a low resistance is obtained at the magnetic carrier level and the electrode effect of the magnetic brush is raised and the developing performance is improved. However, the usual aggregated ferrite particles have a high specific gravity and the stress applied to the magnetic carrier is again large as a result. As a consequence, during extended use, the coating resin on the magnetic carrier undergoes debonding and the ferrite particle becomes exposed to a large degree. As a result, charge leakage occurs at the exposed regions of the low-resistance ferrite particle and, for example, white spots may be produced on the image. However, in the case of a magnetic carrier in which a resin is filled in the pores of a porous ferrite particle, a high-resistance resin component is filled in the interior of the low-resistance ferrite particle and as a consequence the resistance of the resin-filled core is adjusted post-resin filling to a higher level than for an ordinary ferrite particle. Due to this, even when debonding of the coating resin is produced during extended use, the resistance of the magnetic carrier does not fall substantially below the resistance of the resin-filled core and the problems occurring when a low-resistance core is used can be avoided.

The magnetic carrier of the present invention has a resin filled into the pores of the porous ferrite particle and thus has a lower specific gravity than ordinary ferrite carriers and can also reduce the stress on the toner and between magnetic carrier particles. This makes it possible to prevent the debonding of the coating resin caused by extended use and to stabilize the charging performance and developing performance and to thus obtain a high image quality on an extended basis.

The porous ferrite particle in the present invention contains an oxide of Mg in the range from at least 1.00 mass % to not more than 15.00 mass % as MgO with reference to the mass of the porous ferrite particle. From at least 3.00 mass % to not more than 10.00 mass % as MgO is preferred.

When the oxide of Mg is present at less than 1.00 mass % as the oxide with reference to the mass of the porous ferrite particle, the Mg ferrite layer is then small and almost only magnetite ($Fe_2O_3$) is present and a low resistance occurs.

Meanwhile, when the oxide of Mg is present at more than 15.00 mass % as the oxide with reference to the mass of the porous ferrite particle, the difference in the sintering rates between magnetite ($Fe_2O_3$) and MgO becomes large and the structure of the porous ferrite particle tends toward coarseness and the strength of ferrite particle becomes insufficient, and moreover high resistance occurs.

The porous ferrite particle in the present invention contains an oxide of Sr and an oxide of Ca, and the total content of the Sr oxide and Ca oxide is from at least 0.20 mass % to not more than 3.00 mass % as SrO and CaO with reference to the mass of the porous ferrite particle. From at least 0.50 mass % to not more than 2.50 mass % as SrO and CaO is preferred.

By controlling the total content of the Sr oxide and Ca oxide in the present invention into the range indicated above, the resistivity and structure of the surface and interior of the porous ferrite particle and the strength of the core can be brought into favorable ranges as discussed above.

First, by having the total content of the Sr oxide and Ca oxide be from at least 0.20 mass % to not more than 3.00 mass % as SrO and CaO with reference to the mass of the porous ferrite particle, the resistivity of the porous ferrite particle can be adjusted into the previously indicated range and the strength of the core can also be improved. Abnormal particles that are not approximately spherical may be produced when the total content of the Sr oxide and Ca oxide exceeds 3.00 mass %.

When the total content of the Sr oxide and Ca oxide exceeds 3.00 mass %, it is hypothesized that the growth rate of the sintered particles becomes nonuniform; a large particle size distribution is obtained for the sintered particles; and abnormal types appear. As a result of the appearance of a large scatter in the particle diameter of the sintered particles within the core, the strength of the core will be inadequate and members such as the photosensitive member will be scratched and image defects can be caused as a consequence.

When, on the other hand, the total content of the Sr oxide and Ca oxide is less than 0.20 mass %, there is little scatter in crystal growth during sintering and the strength of the core increases as a result. However, because the resistance exhibits a large decline, control into the previously indicated resistivity range is made difficult and breakdown will occur at low field strengths. The following problems, for example, are also produced: because the core exhibits little unevenness, the area ratio of the region originating with the porous ferrite particle core in the magnetic carrier particle surface, infra, cannot be controlled into the prescribed range and an excellent developing performance is then not obtained; also, toner fines caused by extended use are spent onto the magnetic carrier particle surface and the charging performance undergoes a substantial decline.

The magnetic carrier of the present invention has a total area, in the backscattered electron projection image obtained by observation using a scanning electron microscope and an acceleration voltage of 2.0 kV, for the region originating with the porous ferrite particle of from at least 0.2 area % to not more than 5.0 area % and preferably from at least 1.0 area % to not more than 3.5 area %, in each case with reference to the projected area of the magnetic carrier.

When the percentage of the total area of the region originating with the porous ferrite particle with reference to the projected area of the magnetic carrier (this percentage is also referred to as the average percentage Av1 in the following) satisfies the range indicated above, due to the electrode effect in which the magnetic brush—which now has a reduced resistance—acts as an electrode, the force of the field on the toner in the developing segment assumes a large size. It is thought that toner flight is facilitated and the developing performance is improved as a result. In addition, as a consequence of this favorable control of the total area of the region originating with the porous ferrite particle, the countercharge at the magnetic carrier particle surface after toner flight can be rapidly attenuated and the developing performance can be improved still further. An elevated developing performance and an image with a high density that is free of image defects are then made possible as a result.

When this average percentage Av1 is less than 0.2 area %, the countercharge accumulates on the magnetic carrier and a large electrostatic attachment force then operates between the toner and the magnetic carrier and the image density is reduced as a result. When, on the other hand, the average percentage Av1 exceeds 5.0 area %, charge injection into the electrostatic latent image bearing member occurs via the region originating with the low-resistance porous ferrite particle. For example, white spots may be produced on the image as a result. In addition, the amount of charge on the toner may be inadequate and the image may then have a deficient image gradation, and/or the toner may not become adequately charged and toner scattering may be produced.

In order to bring the average percentage Av1 into the range indicated above, it is essential that the total content of the Sr oxide and Ca oxide be controlled into the range given above. By having the Sr oxide and Ca oxide be present at the core surface and the grain boundaries of the grains, a favorable coating of the porous ferrite particle by the vinyl resin is achieved and adjustment of the average percentage Av1 into the previously indicated range is made possible. Achieving the most favorable coating by the vinyl resin is thought to be related to the surface tension of the vinyl resin and the magnitude of the affinity between the vinyl resin and the Sr oxide and Ca oxide present on the surface of the porous ferrite particle.

The average value yielded by averaging the area of the individual regions originating with the porous ferrite particle is preferably from at least 0.45 $\mu m^2$ to not more than 1.40 $\mu m^2$ and more preferably is from at least 0.60 $\mu m^2$ to not more than 1.20 $\mu m^2$ for the magnetic carrier of the present invention. When this average value of the individual areas in the region originating with the porous ferrite particle is in the indicated range, the countercharge produced on the magnetic carrier particle surface can be immediately attenuated and the developing performance is improved still further.

The average value of the area of the individual regions originating with the porous ferrite particle can be adjusted by adjusting the sintered particle diameter of the porous ferrite particle and by varying, for example, the composition and fill amount of the resin, the method of filling the resin, the composition of the coating resin, the amount of the coating resin, and the coating method. It may also be adjusted by controlling the particle-to-particle polishing by adjusting the stirring conditions for the various particles in the devices used in the coating operation. Adjustment into the range indicated above can also be obtained by treating the surface of the magnetic carrier particle after the coating process.

The magnetic carrier of the present invention preferably has a value—in the backscattered electron projection image obtained using a scanning electron microscope and an acceleration voltage of 2.0 kV—of not more than 8.0 area % for the percentage, with respect to the total area of the region originating with the porous ferrite particle, for the total area of the region originating with the porous ferrite particle of the magnetic carrier, in which the area of each of regions originating with the porous ferrite particle is at least 6.672 $\mu m^2$ (this percentage is also referred to as the average percentage Av2 in the following).

When this average percentage Av2 is not more than 8.0 area %, the magnetic carrier of the present invention can exhibit an even more restrained decline in the triboelectric charge quantity even when held after extended use in a high-temperature, high-humidity environment. The relaxation of triboelectric charge between the toner and the magnetic carrier can be inhibited by having there be little region originating with the porous ferrite particle that is present over a wide area on the magnetic carrier particle surface. It is thought that this can result in an inhibition of the decline in the triboelectric charge quantity that occurs in the case of extended use and standing in a high-temperature, high-humidity environment. Thus, it is more preferred that the region originating with the porous ferrite particle in which the area of each of the regions is at least 6.672 $\mu m^2$ not be present at all, i.e., that the average percentage Av2 be 0.0 area %.

The magnetic carrier of the present invention preferably has a value in the backscattered electron projection image obtained using a scanning electron microscope and an acceleration voltage of 2.0 kV of at least 70.0 area % for the percentage, with respect to the total area of the region originating with the porous ferrite particle, for the total area of the region originating with the porous ferrite of the magnetic carrier, in which the area of each of the regions is not more than 2.780 $\mu m^2$ (this percentage is also referred to as the average percentage Av3 in the following).

When this average percentage Av3 is at least 70.0 area %, the magnetic carrier of the present invention exhibits an even better developing performance and an image can be obtained in which there is even less variation in the image density and even fewer image defects such as blank dots and carrier adhesion. The region originating with the porous ferrite particle in which the area of each of the regions is not more than 2.780 $\mu m^2$ is more preferably 100 area % of the region originating with the porous ferrite particle in the magnetic carrier.

In the case of the magnetic carrier in which the average percentage Av3 is at least 70.0 area %, there is a clear increase in the frequency at which contact points occur at the regions originating with the porous ferrite particles between the magnetic carrier particles that form the magnetic brush on the developer bearing member. Due to the occurrence of contact points between the magnetic carrier particles in the regions originating with the low-resistance porous ferrite particle, conductive pathways are formed in the magnetic brush to the developer bearing member from the magnetic carrier particle surfaces on the side of the electrostatic latent image bearing member. As a consequence, conductive pathways are also maintained during development to the developer bearing member from the magnetic carrier particle surfaces and the countercharge produced on the magnetic carrier particle surfaces can then be immediately attenuated.

Figure 1A:
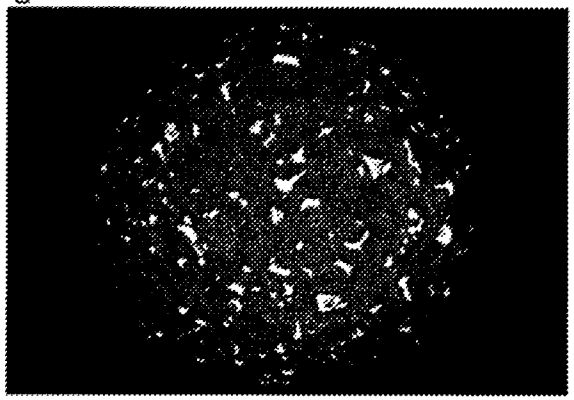
FIG. 1A is a projection image that is a visualization of the backscattered electron image of the magnetic carrier.

In the backscattered electron projection image obtained using a scanning electron microscope at an acceleration voltage of 2.0 kV, the region originating with the porous ferrite particle is observed as a high-brightness (clearly seen in white in the image) region in the image that visualizes mainly the backscattered electrons (FIG. 1A).

The scanning electron microscope is an instrument that visualizes the surface of a sample, as well as compositional information on a sample, by irradiating the sample with an accelerated electron beam and detecting the secondary electrons and backscattered electrons radiated from the sample. It is known that the quantity of radiated backscattered electrons is larger with heavier elements in observations with a scanning electron microscope. For example, in the case of a sample in which an organic compound and iron are distributed on a planar surface, the iron region can be clearly observed (high brightness, white) on the image due to the large quantity of backscattered electrons radiated from the iron. On the other hand, the amount of backscattered electrons from the organic compound, which is composed of light elements, is not large and it is then observed as darkness (low darkness, black) on the image.

A resin (organic compound) region and a region originating with the porous ferrite particle are preferably present on the surface of the magnetic carrier. The region originating with the porous ferrite particle is preferably a low-resistance region in the surface of the magnetic carrier particle, comprising either the exposed surface of the porous ferrite particle or a state in which the porous ferrite particle is thinly coated by the resin. In the case of the backscattered electron projection image of the magnetic carrier of the present invention, a projection image is obtained that presents a large contrast difference in the image—in which the region where the surface of the porous ferrite particle is exposed or where the porous ferrite particle is thinly coated by the resin has a high brightness (i.e., is clearly seen in white on the image) and, conversely, the region where the resin is present at thickness has a low brightness (i.e., is seen as darkness in black on the image).

FIG. 1B schematically shows the distribution in FIG. 1A of the region in which the resin is present at thickness and the high-brightness region where the surface of the porous ferrite particle core is exposed at the magnetic carrier particle surface or where the porous ferrite particle is thinly coated by the resin. The white region corresponds to a region where the surface of the porous ferrite particle is exposed or where the porous ferrite particle is thinly coated by the resin, while the black region corresponds to a region in which the resin is present at thickness.

In the present invention, the projected area of the magnetic carrier is acquired by extracting the magnetic carrier from the projection image of the magnetic carrier in FIG. 1A. The empty white region in FIG. 1C represents the region extracted as the magnetic carrier region from the projection image in FIG. 1A. The region corresponding to the porous ferrite particle is then extracted from the projection image in FIG. 1A (FIG. 1D).

Figure 1D:
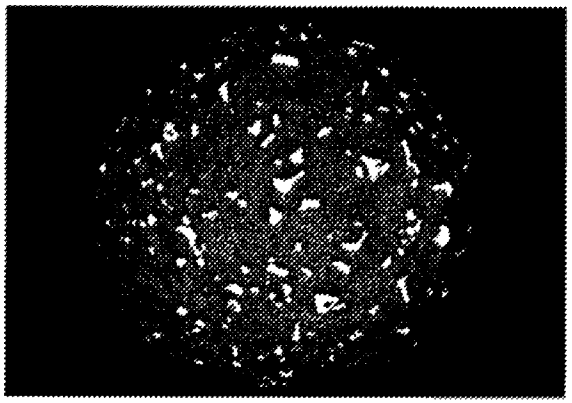
FIG. 1D shows the state provided by image processing of the magnetic carrier in order to extract the region on the magnetic carrier particle surface that originates with the porous ferrite particle (photograph in lieu of drawing)
Figure 1C:
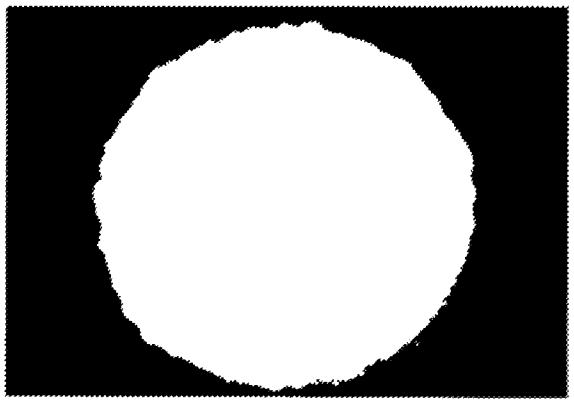
FIG. 1C shows the state provided by extracting the magnetic carrier by the image processing of the magnetic carrier particle.

In FIG. 1D, the empty white locations represent the region originating with the porous ferrite particle. The projected area of the magnetic carrier and the area of the region originating with the porous ferrite particle are each acquired by image processing. This is followed by calculation of the percentage for the total area of the region originating with the porous ferrite particle in the projected area of the magnetic carrier and calculation of the area distribution of the individual region originating with the porous ferrite particle. The details of the scanning electron microscopic observation and photographic conditions and the image processing procedure are given below. In addition, an element analyzer attached to the electron microscope may optionally be used in practice to check whether a white region is a region originating with the porous ferrite core where the surface of the porous ferrite particle is exposed or where the porous ferrite particle is thinly coated by the resin.

The porous ferrite particle used in the present invention has pores that extend from the surface of the particle into its interior. When such a particle is used, for example, the following methods may also be used to control the state of occurrence of the region originating with the porous ferrite particle on the magnetic carrier particle surface.

(1) Methods in which adjustment is performed by, with respect to the resin used to fill the pores of the porous ferrite particle, varying its composition, amount of fill, and method of filling, and, with respect to the vinyl resin used to the coat the surface of the resin-filled core, varying its composition, coated amount, and coating method.

(2) Methods in which the filling or coating operation is performed a plurality of times using filler resin solutions or vinyl coating resin solutions that have different solids concentrations.

(3) Methods in which the viscosity of the resin solution in the filling or coating operation is adjusted.

(4) Methods in which the stirring conditions for the various particles in the devices used in the individual steps are adjusted in order to control the particle-to-particle polishing.

(5) Methods that adjust the particle diameter of the finely pulverized product from the presintered ferrite in the pulverization•granulating step in the production of the porous ferrite particle.

Combinations of these methods may also be used. Moreover, the state of occurrence of the resin and of the region originating with the porous ferrite particle may also be controlled by performing a treatment on the magnetic carrier particle surface after the coating operation with the vinyl resin. For example, the surface of the porous ferrite particle can be partially exposed by magnetic carrier-to-magnetic carrier polishing while subjecting the resin-coated magnetic carrier to a heat treatment while rotating a rotatable vessel having a stirring paddle in its interior, for example, a drum mixer (Sugiyama Heavy Industrial Co., Ltd.). Treatment for at least 0.5 hours at a temperature of at least 100° C. in the drum mixer is preferred. Control of the state of occurrence of the resin on the magnetic carrier particle surface is easily carried out structurally with the porous ferrite particle.

The ferrite composing the porous ferrite particle is a sintered compact represented by the following formula in the present invention.

$$(M1_2O)_u(M2O)_v(M3_2O_3)_w(M4O_2)_x(M5_2O_5)_y(Fe_2O_3)_z$$

(In the formula, M1 is a monovalent metal, M2 is a divalent metal, M3 is a trivalent metal, M4 is a tetravalent metal, and M5 is a pentavalent metal, and, when $u+v+w+x+y+z=1.0$ is imposed, u, v, w, x, and y are each $0 \leq (u, v, w, x, y) \leq 0.8$ and z is $0.2<z<1.0$.)

The M1 to M5 in the preceding formula represent at least one metal element selected from the group consisting of at least Li, Fe, Zn, Ni, Mn, Mg, Co, Cu, Ba, Sr, Ca, Si, V, Bi, In, Ta, Zr, B, Mo, Na, Sn, Ti, Cr, Al, Sc, Y, La, Ce, Pr, Nd, Sm, Eu, Gd, Tb, Dy, Ho, Er, Tm, Yb, and Lu.

The porous ferrite particle used by the present invention is a magnetic Mg ferrite [for example, $(MgO)_a(Fe_2O_3)_b$ ($0.0<a<0.4$, $0.6 \leq b<1.0$, $a+b=1$)] in which the aforementioned ferrite represents the main elements and Sr and Ca are incorporated in addition thereto as trace metals. The other metal elements indicated above may be incorporated to the extent that the effects of the present invention are not impaired.

The 50% particle diameter (D50) on a volume basis of the porous ferrite particle is preferably from at least 18.0 μm to not more than 68.0 μm in the present invention from the standpoint of the resistance to toner spenting and preventing carrier adhesion. When a resin is filled into the pores of a porous ferrite particle with such a particle diameter and the surface of the obtained resin-filled core is coated with vinyl resin, the 50% particle diameter (D50) on a volume basis then becomes from about at least 20.0 μm to not more than 70.0 μm.

In order to ultimately manifest the properties of a magnetic carrier, the porous ferrite particle preferably has an intensity of magnetization at $1000/4\pi$ (kA/m) of from at least 50 $Am^2/kg$ to not more than 75 $Am^2/kg$ in the present invention. By having the intensity of magnetization satisfy this range, a magnetic carrier is obtained that can improve the dot reproducibility, which governs the image quality in halftone regions, and that can prevent carrier adhesion and can provide a stable image by preventing toner spenting.

In order to obtain an appropriate true specific gravity at the level of the ultimately obtained magnetic carrier, the true specific gravity of the porous ferrite particle is preferably from at least 4.2 $g/cm^3$ to not more than 5.9 $g/cm^3$ in the present invention.

The process of producing the porous ferrite particle is described in the following.

<Step 1 (Weighing/Mixing Step)>

The starting materials for the ferrite under consideration are weighed out and mixed. Following substances are examples of ferrite materials: particles, oxides, hydroxides, oxalates, and/or carbonates of metal elements are selected from Mn, Mg, Sr, and Ca. The mixing apparatus can be exemplified by ball mills, planetary mills, Giotto mills, and vibrating mills.

Ball mills are particularly preferred from the standpoint of the mixing characteristics.

<Step 2 (Presintering Step)>

The pulverized/mixed ferrite starting materials are presintered in air for from at least 0.5 hours to not more than 5.0 hours in a sintering temperature range of from at least 700° C. to not more than 1000° C. in order to carry out ferritization. For example, an oven or furnace as follows is used for the sintering: a burner-type sintering furnace, a rotary sintering furnace, or an electric furnace.

<Step 3 (Pulverization Step)>

The presintered ferrite produced in step 2 is pulverized using a pulverizer. This pulverizer can be exemplified by the following: crushers, hammer mills, ball mills, bead mills, planetary mills, and Giotto mills.

In addition, the 50% particle diameter (D50) on a volume basis of the finely pulverized presintered ferrite product is preferably made from at least 0.5 μm to not more than 5.0 μm. The finely pulverized ferrite product is preferably brought to the particle diameters given above, for example, by controlling the material and particle diameter of the balls or beads used in a ball mill or bead mill and by controlling the operating time. The particle diameter of the balls or beads is not particularly limited as long as the desired particle diameter/distribution can be obtained. In the case of balls, for example, balls with a diameter of from at least 5 mm to not more than 60 mm are favorably used. In the case of beads, beads with a diameter of from at least 0.03 mm to less than 5 mm are favorably used.

In addition, in comparison to dry methods, the use of wet methods in a ball mill or bead mill provides a higher pulverization efficiency without upward flight of the pulverization product in the mill, and for this reason wet methods are more preferred than dry methods.

<Step 4 (Granulating Step)>

Water, a dispersing agent, a binder, and optionally a blowing agent as a pore modifier and/or resin particles and sodium acid carbonate are added to the obtained finely pulverized presintered ferrite product. For example, polyvinyl alcohol may be used as the binder.

The obtained ferrite slurry is dried/granulated using an atomizing dryer in a heated atmosphere of from at least 100° C. to not more than 200° C. There are no particular limitations on the atomizing dryer as long as the desired particle diameter can be obtained for the porous ferrite particle. For example, a spray dryer may be used.

<Step 5 (Main Sintering Step)>

The granulate is then sintered for from at least 1 hour to not more than 24 hours at from at least 800° C. to not more than 1400° C.

The pore volume of the interior of the porous ferrite particle can be regulated by setting the sintering time and/or the sintering temperature. Raising the sintering temperature and lengthening the sintering time cause sintering to advance, which results in a smaller pore volume in the interior of the porous ferrite particle. In addition, the resistivity of the magnetic carrier core can be adjusted into the preferred range by controlling the sintering atmosphere. For example, the resistivity of the porous ferrite particle can be reduced by lowering the oxygen concentration and by establishing a reducing atmosphere (presence of hydrogen).

<Step 6 (Classification Step)>

After the particles sintered as described above have been ground, as necessary the coarse particles and/or fines may be removed by classification or sieving on a sieve.

In addition, the magnetic carrier of the present invention is a magnetic carrier in which a resin has been filled into at least a portion of the pores in the porous ferrite particle.

The physical strength of the porous ferrite particle may be lowered depending on the pore volume in the interior. Accordingly, a resin is filled into the pores of the porous ferrite particle in order to increase the physical strength at the magnetic carrier level and in order to control the resistance value of the resin-filled core after resin filling.

The amount of resin filled into the pores of the porous ferrite particle of the present invention is preferably from at least 6 mass % to not more than 25 mass % with reference to the porous ferrite particle. There are no particular limitations on the specific method for filling resin into the pores of the porous ferrite particle, and this method can be exemplified by immersion methods, spray methods, brushing methods, and a coating method such as a fluidized bed by which a resin solution is impregnated into the porous ferrite particle and a method of subsequently evaporating the solvent.

A method is preferably used in which the resin is diluted in a solvent and this is added into the pores of the porous ferrite particle. The solvent used in this case should be able to dissolve the resin. For the case of an organic solvent-soluble resin, the organic solvent can be exemplified by toluene, xylene, butyl cellosolve acetate, methyl ethyl ketone, methyl isobutyl ketone, and methanol. Water may be used as the solvent in the case of water-soluble resins and emulsion-type resins.

There are no particular limitations on the resin that may be filled into the pores of the porous ferrite particle, and, while a thermoplastic resin or a thermosetting resin may be used, a resin that exhibits a high affinity for the porous ferrite particle is preferred. A resin that has a high affinity for the porous ferrite particle core is preferred. As such a resin, silicone resins and modified silicone resins are specifically preferred because they have a high affinity for the porous ferrite particle.

The following are examples of commercially available products: straight silicone resins such as KR251, and KR255 from Shin-Etsu Chemical Co., Ltd., and SR2440, and SR2411 from Dow Corning Toray Co., Ltd., as well as modified silicone resins such as KR206 (alkyd modified), KR5208 (acrylic modified), ES1001N (epoxy modified), and KR305 (urethane modified) from Shin-Etsu Chemical Co., Ltd., and SR2115 (epoxy modified) and SR2110 (alkyd modified) from Dow Corning Toray Co., Ltd.

The magnetic carrier of the present invention is a magnetic carrier in which a vinyl resin is coated on the surface of the resin-filled core that has been provided by filling a resin into the pores of the porous ferrite particle. For adjusting the percentage of the total area of the region originating with the porous ferrite particle in the projected area of the magnetic carrier and adjusting the area distribution of the individual region originating with the porous ferrite particle, a vinyl resin is essential from the standpoint of wetting the filled core and the adhesiveness with the filled core.

There are no particular limitations on the method for coating the surface of the resin-filled core with the vinyl resin, and this method can be exemplified by methods in which coating is performed by an application method such as immersion, spraying, brush application, dry methods, and a fluidized bed. Among these, immersion methods that can bring about the appropriate exposure of the surface of the resin-filled core are more preferred.

With regard to the coated amount of the vinyl resin, from at least 0.1 mass parts to not more than 5.0 mass parts for each 100 mass parts of the resin-filled core is preferred for adjusting the percentage of the total area of the region originating with the porous ferrite particle in the projected area of the magnetic carrier. A single vinyl resin may be used for the coated vinyl resin or a mixture of two or more vinyl resins may be used.

With regard to the vinyl resin used in the present invention, the copolymer of a vinyl monomer having a cyclic hydrocarbon group in the molecular structure and another vinyl monomer is preferred for obtaining releasability by the toner from the magnetic carrier particle surface and for preventing contamination by the external additive and toner fines. The inhibitory effect on the decline in the amount of charge in a high-temperature, high-humidity environment can also be further improved by coating with such a vinyl resin.

The cause of the improvement in the inhibitory effect on the decline in the amount of charge in a high-temperature, high-humidity environment due to the application of this vinyl resin is thought to be as follows. The application of this vinyl resin on the surface of the resin-filled core proceeds via a coating step in which the vinyl resin dissolved in an organic solvent is mixed with the resin-filled core and the solvent is removed. In this step, the cyclic hydrocarbon group orients to the surface of the coating resin layer while the solvent is being removed and a coating resin layer is then formed in which the highly hydrophobic cyclic hydrocarbon group is oriented to the surface of the finished magnetic carrier.

The cyclic hydrocarbon group can be exemplified by cyclic hydrocarbon groups that have from at least 3 to not more than 10 carbons. Specific examples are the cyclohexyl group, cyclopentyl group, adamantyl group, cyclopropyl group, cyclobutyl group, cycloheptyl group, cyclooctyl group, cyclononyl group, cyclodecyl group, isobornyl group, norbornyl group, and bornyl group. Among the preceding, the cyclohexyl group, cyclopentyl group, and adamantyl group are preferred while the cyclohexyl group is particularly preferred because it is structurally stable and provides a high adhesiveness to the resin-filled core.

The other vinyl monomer referenced above is not particularly limited as long as the glass-transition temperature (Tg) can be regulated, and known monomers can be used. Specific examples are styrene, ethylene, propylene, butylene, butadiene, vinyl chloride, vinylidene chloride, vinyl acetate, methyl methacrylate, ethyl methacrylate, propyl methacrylate, vinyl methyl ether, vinyl ethyl ether, and vinyl methyl ketone.

In addition, in order to control the charging performance, the vinyl resin may also incorporate, for example, electroconductive particles, particles that have a charge control function, a charge control agent, a charge control resin, and various coupling agents.

The electroconductive particles can be exemplified by carbon black, magnetite, graphite, zinc oxide, and tin oxide. An amount of addition of from at least 0.1 mass parts to not more than 10.0 mass parts for each 100 mass parts of the vinyl resin is preferred for regulating the resistance. The particles having a charge-control function can be exemplified by particles of an organometallic complex, particles of an organometallic salt, particles of a chelate compound, particles of a monoazometal complex, particles of an acetylacetone-metal complex, particles of a hydroxycarboxylic acid-metal complex, particles of a polycarboxylic acid-metal complex, particles of a polyol-metal complex, particles of a polymethyl methacrylate resin, particles of a polystyrene resin, particles of a melamine resin, particles of a phenolic resin, particles of a nylon resin, silica particles, titanium oxide particles, and alumina particles. An amount of addition for the particles having a charge control function of from at least 0.5 mass parts to not more than 50.0 mass parts for each 100 mass parts of the vinyl resin is preferred for regulating the triboelectric charge quantity.

The charge control agent can be exemplified by nigrosine dyes, the metal salts of a naphthenic acid or a higher fatty acid, alkoxylated amines, quaternary ammonium salt compounds, azo metal complexes, and the metal salts and metal complexes of salicylic acid. For the purpose of increasing the negative charge-providing behavior, the charge control agent is preferably a nitrogen-containing compound. A sulfur-containing compound is preferred for a positive charge-providing behavior. The amount of addition of the charge control agent is preferably from at least 0.5 mass parts to not more than 50.0 mass parts for each 100 mass parts of the vinyl resin in order to achieve a good dispersibility and in order to regulate the amount of charge.

Amino group-containing resins and quaternary ammonium group-containing resins are preferred charge control resins for a negative charge-providing behavior. For obtaining both the release action of the vinyl resin and a charge-providing performance, the amount of addition of the charge control resin is preferably from at least 0.5 mass parts to not more than 30.0 mass parts for each 100 mass parts of the vinyl resin.

A nitrogen-containing coupling agent is preferred for the coupling agent in order to increase the negative charge-providing performance. An amount of coupling agent addition of from at least 0.5 mass parts to not more than 50.0 mass parts for each 100 mass parts of the vinyl resin is preferred for regulating the amount of charge.

The magnetic carrier of the present invention preferably exhibits unevenness in its surface. When a magnetic carrier having an uneven surface is used, this becomes the point of contact between the toner and the magnetic carrier and the attachment force by the toner to the magnetic carrier can be diminished, and a high developing performance is exhibited as a consequence. In addition, a structure is maintained in which the resin in the depressed portions of the ferrite particle is resistant to being sliced off while the low-resistance ferrite particle is exposed at the protruded portions. As a consequence, the toner is stably charged on an extended basis by the resin in the depressed portions while the countercharge produced post-development at the magnetic carrier particle surface is efficiently leaked from the protruded portions into the interior of the magnetic carrier, and a high developing performance is thereby maintained on an extended basis. Since substantial unevenness is present in the surface of the porous ferrite particle, a magnetic carrier having unevenness in its surface can be readily obtained by carrying out filling and coating with the resins so as to retain the uneven configuration of the ferrite particle.

The magnetic carrier of the present invention preferably has a 50% particle diameter (D50) on a volume basis of from at least 30.0 μm to not more than 70.0 μm from the standpoint of enabling an inhibition of carrier adhesion and toner spenting and enabling stable use even during extended use.

The magnetic carrier of the present invention preferably has an intensity of magnetization at $1000/4\pi$ (kA/m) of from at least 40 $Am^2/kg$ to not more than 65 $Am^2/kg$ in order to improve the dot reproducibility and prevent carrier adhesion and toner spenting and thus obtain a stable image. The true specific gravity of the magnetic carrier of the present invention is preferably from at least 3.5 $g/cm^3$ to not more than 4.2 $g/cm^3$ in order to prevent toner spenting and maintain a stable image on an extended basis. Viewed from the standpoint of obtaining an excellent inhibition of carrier adhesion and raising the durability still further, the true specific gravity is more preferably from at least 3.6 $g/cm^3$ to not more than 4.1 $g/cm^3$.

The residual magnetization of the magnetic carrier of the present invention after the application of an external magnetic field of 1000/4π (kA/m) is preferably not more than 3.0 $Am^2/kg$. Controlling the residual magnetization into this range makes it possible to maintain the flowability of the developer and in particular to maintain developer flowability even after extended use and makes it possible for the replenished toner to be rapidly dispersed in the developer in the developer tank and for uniform mixing to occur. The residual magnetization is more preferably not more than 2.0 $Am^2/kg$ in order to provide an excellent charge rise and inhibit fogging during developer replenishment.

The two-component developer of the present invention contains at least the magnetic carrier of the present invention and a toner that has toner particles that contain at least a binder resin and a colorant.

By using the magnetic carrier of the present invention, the two-component developer of the present invention can provide a substantial reduction in the stress between the toner and magnetic carrier in the developing device. This results in an additional inhibition of attachment of small diameter toner particles to the magnetic carrier. As a consequence, charge stability during toner replenishment can be maintained on an extended basis and the generation of image defects such as fogging can be inhibited.

The toner used in the two-component developer of the present invention is described in the following.

The toner used in the two-component developer of the present invention is a toner that has toner particles that contain at least a binder resin and a colorant. The weight-average particle diameter (D4) of this toner is preferably from at least 3.0 μm to not more than 8.0 μm.

In order for the storability and low-temperature fixability of the toner to coexist in balance, the binder resin in the toner preferably has a peak molecular weight (Mp) in the molecular weight distribution measured by gel permeation chromatography (GPC) of from at least 2000 to not more than 50000, a number-average molecular weight (Mn) of from at least 1500 to not more than 30000, and a weight-average molecular weight (Mw) of from at least 2000 to not more than 1000000. In addition, its glass-transition temperature (Tg) is preferably from at least 40° C. to not more than 80° C.

The colorant present in the toner may be a known colored pigment for magenta toners, colored dye for magenta toners, colored pigment for cyan toners, colored dye for cyan toners, colored pigment for yellow toners, colored dye for yellow toners, black colorant, or colorant mixed to give black using a yellow colorant, a magenta colorant, and a cyan colorant. A pigment may be used by itself as the colorant, but the co-use of a dye and a pigment to improve the sharpness is more preferred from the standpoint of the image quality of full-color images. The amount of colorant use, expressed per 100 mass parts of the binder resin, is preferably from at least 0.1 mass parts to not more than 30 mass parts, more preferably from at least 0.5 mass parts to not more than 20 mass parts, and even more preferably from at least 3 mass parts to not more than 15 mass parts.

The toner may optionally contain a wax, and the amount of use of the wax, expressed per 100 mass parts of the binder resin, is preferably from at least 0.5 mass parts to not more than 20 mass parts and more preferably from at least 2 mass parts to not more than 8 mass parts. Viewed from the standpoint of having the toner storability and hot resistance offset property coexist in balance, the peak temperature of the maximum endothermic peak of the wax is preferably from at least 45° C. to not more than 140° C.

The toner may also optionally contain a charge control agent. A known charge control agent can be used as the charge control agent in the toner, but a colorless metal compound of an aromatic carboxylic acid that can improve the charging speed of the toner and can stably maintain a prescribed charge is particularly preferred. The amount of addition of this charge control agent is preferably from at least 0.2 mass parts to not more than 10 mass parts for each 100 mass parts of the binder resin.

The toner preferably contains toner particles and inorganic fine particles that have a number-average primary particle diameter of from at least 60 nm to not more than 300 nm, and the coverage ratio of the toner particles by the inorganic fine particles is preferably at least 60%.

The inorganic fine particles used by the present invention preferably function as spacer particles that increase the release action between the toner and the magnetic carrier. In addition, in order to inhibit the detachment of the inorganic fine particles from the toner, the number-average primary particle diameter of the inorganic fine particles is preferably from at least 60 nm to not more than 300 nm. Viewed from the standpoint of preventing the inorganic fine particles from becoming embedded in the toner particles, the inorganic fine particles having a number-average primary particle diameter of from at least 60 nm to not more than 300 nm that are used by the present invention are preferably externally added so as to provide a coverage ratio for the toner particles of at least 60%.

The coverage ratio by the inorganic fine particles having a number-average primary particle diameter of from at least 60 nm to not more than 300 nm can be adjusted into the indicated range by regulating the amount of addition of the inorganic fine particles and by regulating the mixing time with the toner particles.

For reducing the change in the flowability of the developer after extended use, the toner used in the two-component developer of the present invention preferably contains in addition to the toner particles and the inorganic fine particles having a number-average primary particle diameter of from at least 60 nm to not more than 300 nm (also referred to below as inorganic fine particles (A))—inorganic fine particles (B) that have a different size from the inorganic fine particles (A). The inorganic fine particles (B) preferably have a BET specific surface area of from at least 100 $m^2/g$ to not more than 250 $m^2/g$.

Moreover, the inorganic fine particles (A) and (B) are preferably both silica fine particles from the standpoint of having the toner flowability and the charging performance coexist in balance. These inorganic fine particles (A) and (B) are preferably hydrophobed using a hydrophobic agent such as a silane compound, a silicone oil, or their mixtures.

In order to improve the flowability still further, another external additive may be added to the toner in addition to the inorganic fine particles (A) and (B), and inorganic fine particles such as silica, titanium oxide, and aluminum oxide are preferred for this external additive. These inorganic fine particles are preferably hydrophobed using a hydrophobic agent such as a silane compound, a silicone oil, or their mixtures. The other external additive has at least one maximum value in the range from at least 20 nm to not more than nm in the particle size distribution on a number basis.

The total content of the inorganic fine particles (A) and (B) and the other external additive(s), expressed with reference to each 100 mass parts of the toner particles, is preferably from at least 1.0 mass part to not more than 8.0 mass parts and more preferably is from at least 2.0 mass parts to not more than 5.5 mass parts. The content of the inorganic fine particles (A), expressed with reference to each 100 mass parts of the toner particles, is preferably from at least 0.1 mass parts to not more than 4.0 mass parts and more preferably is from at least 0.5 mass parts to not more than 3.0 mass parts. The action as a spacer particle is more substantial when the inorganic fine particle (A) content is in this range.

As above, the surfaces of the inorganic fine particles and the other external additive(s) are preferably subjected to a hydrophobic treatment with a hydrophobic agent such as a silane compound, a silicone oil, or mixtures thereof.

This hydrophobic treatment is preferably carried out by coating the particles to be treated by adding thereto the hydrophobic treatment agent at from at least 1 mass % to not more than 30 mass % (more preferably from at least 3 mass % to not more than 7 mass %) with reference to the particles to be treated. There are no particular limitations on the degree of hydrophobing of the hydrophobically treated inorganic fine particles and other external additive(s), but, for example, a post-treatment hydrophobicity of from at least 40 to not more than 98 is preferred. This hydrophobicity is a known index that represents the hydrophobic character and indicates the wettability of the sample by methanol. A known mixing device, such as a HENSCHEL mixer, can be used to mix the toner particles, inorganic fine particles, and other external additive(s).

The toner particles used in the present invention can be obtained by kneading pulverization methods, dissolution suspension methods, suspension polymerization methods, emulsion polymerization and aggregation methods, and aggregation methods, and there are no particular limitations on these production methods.

The toner particle production sequence using a kneading pulverization method is described in the following.

In a raw material mixing step, the materials that will constitute the toner particles, for example, the binder resin, colorant, and if necessary wax, the charge-control agent, and other components, are metered out in prescribed amounts, blended, and mixed. The mixer can be exemplified by double-cone mixers, V-mixers, drum mixers, super mixers, HENSCHEL mixers, NAUTA mixers, and the MECHANO HYBRID (Mitsui Mining Co., Ltd.).

The resulting raw material mixture is then melt kneaded in order to disperse the colorant and so forth in the binder resin. A batch kneader, e.g., a pressure kneader or a Banbury mixer, or a continuous kneader can be used in this melt kneading step, and a singe-screw or twin-screw extruder is typically used because today they offer the advantage of enabling continuous production. Specific examples here are the KTK twin-screw extruder (Kobe Steel, Ltd.), TEM twin-screw extruder (Toshiba Machine Co., Ltd.), PCM kneader (Ikegai Corp.), Twin Screw Extruder (KCK), Co-Kneader (Buss), and Kneadex (Mitsui Mining Co., Ltd.).

The colored resin composition obtained by melt kneading may additionally be rolled out using, for example, a two-roll mill and cooled in a cooling step, for example, with water.

The melt kneaded composition that has been cooled is then pulverized to the desired particle diameter in a pulverization step. In the pulverization step, a coarse pulverization is performed using a grinder such as a crusher, hammer mill, or feather mill, followed by a fine pulverization using a pulverizer such as a Krypton System (Kawasaki Heavy Industries, Ltd.), Super Rotor (Nisshin Engineering Inc.), or Turbo Mill (Turbo Kogyo Co., Ltd.) or using an air jet system.

The toner particles are then obtained as necessary by carrying out classification using a sieving apparatus or a classifier, e.g., an internal classification system such as the Elbow Jet (Nittetsu Mining Co., Ltd.) or a centrifugal classification system such as the Turboplex (Hosokawa Micron Corporation), TSP Separator (Hosokawa Micron Corporation), or Faculty (Hosokawa Micron Corporation).

Figure 2:
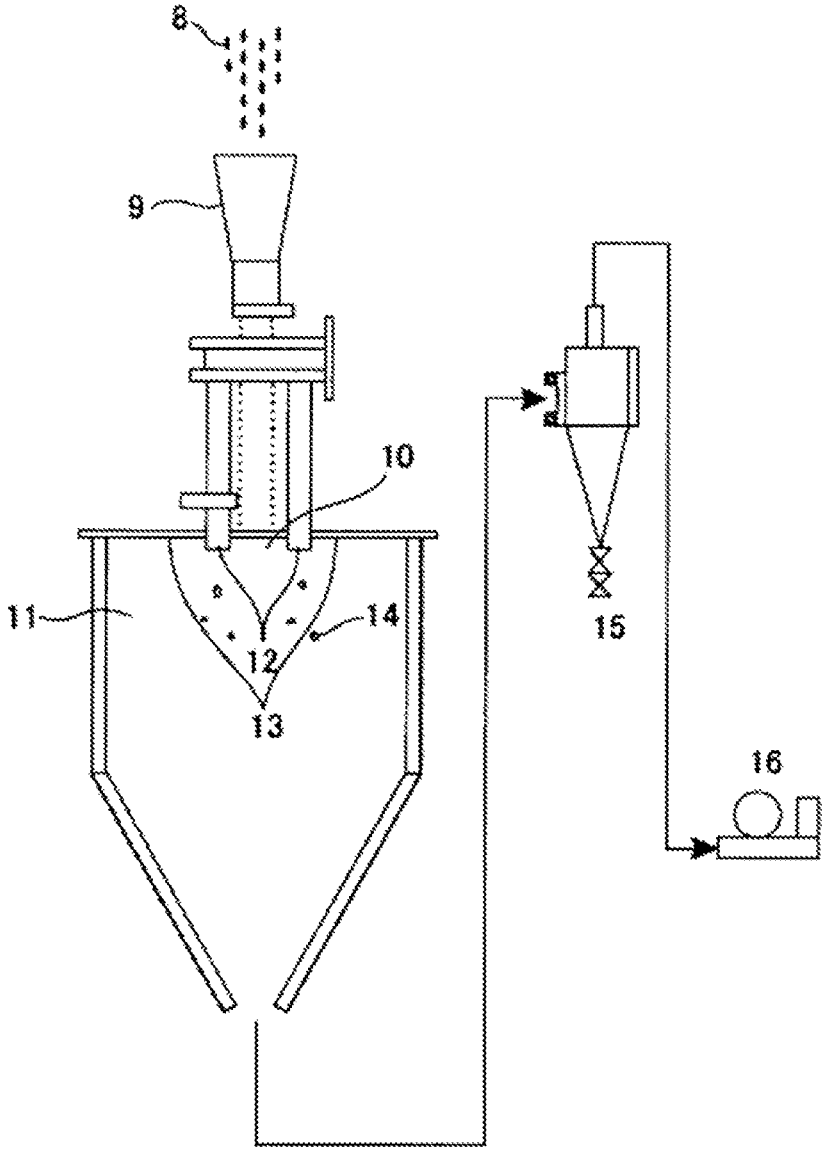
FIG. 2 is a schematic drawing of a surface modification apparatus.

After pulverization, the toner particles may as necessary also be subjected to a surface modification treatment, such as a spheronizing treatment, using a Hybridization System (Nara Machinery Co., Ltd.), Mechanofusion System (Hosokawa Micron Corporation). For example, a surface modification apparatus as shown in FIG. 2 may be used. A predetermined volume of the toner particles 8 are fed to the interior of a surface modification apparatus 11 via an auto feeder 9 and a feed nozzle 10. The air in the interior of the surface modification apparatus 11 is suctioned through the action of a blower 16 and the toner particles 8 introduced from the feed nozzle 10 are dispersed in the interior of the apparatus. The toner particles 8 dispersed in the interior of the apparatus undergo surface modification through the instantaneous application of heat by a hot air current that is introduced from a hot air current introduction port 12. The hot air current is produced by a heater in the present invention, but there is no particular limitation on the apparatus as long as it can produce a hot air current sufficient to effect surface modification of the toner particles. The surface-modified toner particles 14 are instantaneously cooled by a cold air current introduced from a cold air current introduction port 13. Liquid nitrogen is used for the cold air current in the present invention, but there is no particular limitation on the means as long as the surface-modified toner particles 14 can be instantaneously cooled. The surface-modified toner particles 14 are suctioned off by the blower 16 and are collected by a cyclone 15.

The two-component developer of the present invention may be used as the developer filled at the start of development or may be used as a replenishing developer that is supplied to the developing device after durability testing. When used as a developer at the time of starting development, the mixing ratio between the magnetic carrier and toner is preferably from at least 2 mass parts to not more than 35 mass parts of toner and more preferably is from at least 4 mass parts to not more than 25 mass parts of toner, per 100 mass parts of the magnetic carrier. Compliance with this range makes it possible to achieve a high image density and reduce toner scattering. In the case of use as a replenishing developer, viewed from the standpoint of increasing the durability of the developer, preferably toner of from at least 2 mass parts to not more than 50 mass parts per 1 mass part of the magnetic carrier is used.

The methods used to measure the various properties of the previously described magnetic carrier and toner are described in the following.

<Method for Extracting the Region Originating with the Porous Ferrite Particle on the Magnetic Carrier and Calculating its Area Percentage>

The extraction of the region originating with the porous ferrite particle on the magnetic carrier and its area percentage can be determined by observation of the backscattered electron image with a scanning electron microscope followed by image processing. The extraction of the region originating with the porous ferrite particle on the magnetic carrier and the measurement of its area were performed using an S-4800 scanning electron microscope (SEM) (Hitachi, Ltd.). The area percentage of the region originating with the porous ferrite particle is calculated by performing image processing on the projection image that visualizes the backscattered electrons and that is obtained using this scanning electron microscope and an acceleration voltage of 2.0 kV.

Specifically, the magnetic carrier is fixed as a single layer with carbon tape on the sample stub for electron microscopic observation and the observation is carried out using the following conditions without vapor deposition with platinum. The observation is performed after a flashing procedure.

[Observation Conditions]
SignalName=SE (U, LA80)
AcceleratingVoltage=2000 Volt
EmissionCurrent=10000 nA
WorkingDistance=6000 μm
LensMode=High
Condenser1=5
ScanSpeed=Slow4 (40 seconds)
Magnification=600
DataSize=1280×960
ColorMode=Grayscale For the backscattered electron image, a projection image of the magnetic carrier (FIG. 3A) was obtained with the control software for the S-4800 scanning electron microscope set as follows: "contrast 5, adjust brightness to brightness 5, Slow4 (40 seconds) for capture speed/number of frame integration", and 8-bit 256-gradation grayscale image with an image size of 1280×960 pixels. Using the scale on the image, the length of 1 pixel is then 0.1667 μm and the area of 1 pixel is 0.0278 $\mu m^2$. Using the obtained backscattered electron projection image, the area percentage (area %) of the region originating with the porous ferrite particle core is subsequently calculated for 50 magnetic carriers. The details of the method for selecting the 50 magnetic carriers that undergo the analysis are described below. Image-Pro Plus 5.1J (Media Cybernetics, Inc.) image processing software is used for the area % of the region originating with the porous ferrite particle.

Figures 3A, 3B, 3C, 3D, 3E, 3F:
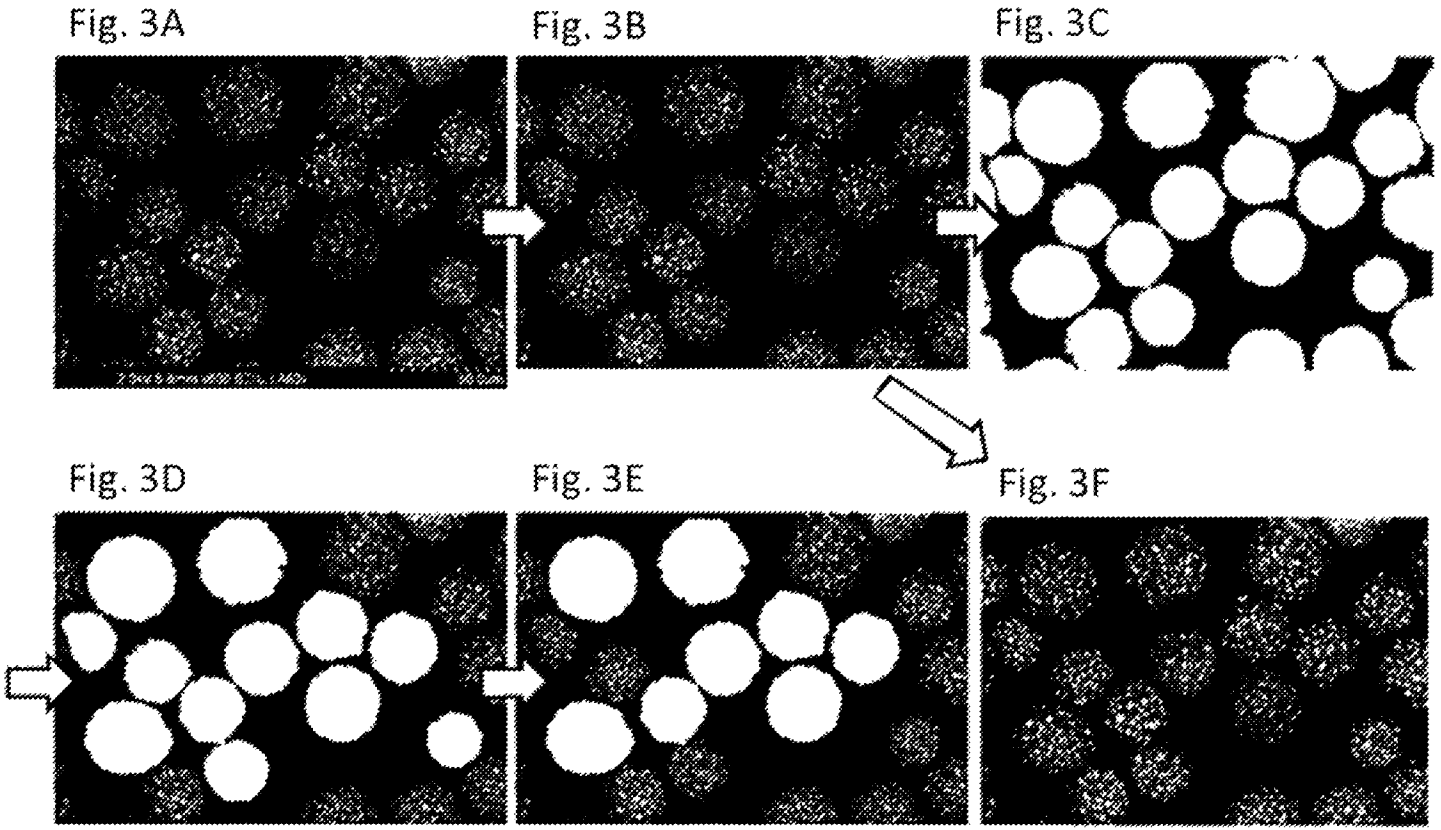
FIG. 3A is a projection image that visualizes the electrons backscattered from the magnetic carrier, at a magnification of 600×.
FIG. 3B is a diagram that shows the state after preprocessing in the image processing of the projection image that visualizes the electrons backscattered from the magnetic carrier.
FIG. 3C is a diagram that shows the state provided by extraction of the magnetic carriers from the projection image that visualizes the electrons backscattered from the magnetic carriers.
FIG. 3D is a diagram that shows the state provided by the elimination of the magnetic carriers at the periphery of the image, from the magnetic carriers that have been extracted from the projection image that visualizes the electrons backscattered from the magnetic carriers.
FIG. 3E is a diagram that shows the state provided by the additional particle diameter-based culling of the particles undergoing image processing, from the magnetic carriers extracted as shown in FIG. 3D.
FIG. 3F is a diagram that describes the state provided by the extraction of the region originating with the porous ferrite particle on the magnetic carrier (photograph in lieu of drawing)

First, the projection image visualizing the electrons backscattered from the magnetic carrier is obtained at a magnification of 600× (FIG. 3A). Image processing is not required for the character string at the bottom of the image in FIG. 3A and the unnecessary area is deleted and the image is cropped to a size of 1280×895 (FIG. 3B).

Then, the magnetic carrier region is extracted and the size of the extracted magnetic carrier region is counted. Specifically, in order to extract the magnetic carrier undergoing analysis, the background region is first isolated from the magnetic carrier. "Measurement"-"Count/Size" is selected in the Image-Pro Plus 5.1J. The brightness range is set to a range of 50 to 255 using the "Brightness Range Selection" of "Count/Size" and the unwanted low-brightness carbon tape region is eliminated as background and extraction of the magnetic carrier is performed (FIG. 3C). When the magnetic carrier is fixed by a method other than the use of carbon tape, the background may then not necessarily be a low-brightness region, or the possibility that the background assumes a brightness that to some degree is the same as the magnetic carrier cannot be excluded. However, discrimination can be easily performed from the backscattered electron projection image at the boundary between the magnetic carrier and background. When the extraction was performed, 4 links was selected, smoothness 5 was input, and a check was entered in gap filling in the extraction options of "Count/Size" and particles located on any boundary (periphery) of the image and particles overlapping with another particle were excluded from the calculation. Then, in the measurement items in "Count/Size", area and Feret diameter (average) were selected and the area selection range was set to a minimum of 300 pixels and a maximum of 10000000 pixels (FIG. 3D). In addition, for the Feret diameter (average), the selection range is set to provide a diameter range that is ±25% of the measured value of the 50% particle diameter (D50) on a volume basis of the magnetic carrier, vide infra, and the magnetic carrier undergoing image analysis is extracted (FIG. 3E). One particle is selected from the extracted particle group, and the size (ja) (number of pixels) of the region originating with this particle is determined.

Then, the brightness range was set to the range of 140 to 255 in the "Brightness Range Selection" of "Count/Size" of the Image-Pro Plus 5.1J and extraction of the high-brightness regions on the magnetic carrier was performed (FIG. 3F). The area selection range is set to a minimum of 10 pixels and a maximum of 10000 pixels.

In addition, the size (ma) (number of pixels) of the region originating with the porous ferrite particle on the magnetic carrier particle surface is determined for the particles selected in the determination of ja. For each magnetic carrier, the extracted region originating with the porous ferrite particle is present as scattered areas having certain sizes, but ma is the total area therefor.

The same processing was then performed on each of the particles in the extracted particle group until the number of selected magnetic carriers reached 50. When the number of particles in one visual field did not reach 50, the same operation was repeated on the projection image of magnetic carriers in another visual field.

The percentage (average percentage Av1) according to the present invention for the total area of the region originating with the porous ferrite particle with respect to the projected area of the magnetic carrier is calculated with the following formula using the total value "Ma" of the ma values measured on 50 particles and the total value "Ja" of the ja values measured for the same 50 particles.

$$\text{average percentage } Av1=(Ma/Ja)\times 100$$

<Method of Calculating the Area Distribution with Respect to the Total Area of the Region Originating with the Porous Ferrite Particle>

The area percentages (average percentage Av2 (area %) and average percentage Av3 (area %)) with respect to the total area of the region originating with the porous ferrite particle core, of the total area for the regions in which the area of each of regions is at least 6.672 $\mu m^2$ and the total area for the regions in which the area of each of regions is not more than 2.780 $\mu m^2$, are determined by observation of the backscattered electron projection image obtained using the aforementioned scanning electron microscope and an acceleration voltage of 2.0 kV and by image processing and statistical processing of the processed image.

Specifically, using the same methodology as indicated above for extracting the region originating with the porous ferrite particle on the magnetic carrier and for calculating its area percentage, 50 magnetic carriers are observed and the region originating with the porous ferrite particle on the magnetic carrier is extracted from the image. The size of each region in the extracted region originating with the porous ferrite particle is determined for the 50 magnetic carriers and is distributed into 20 pixel-wide channels. Here, the area of 1 pixel is 0.0278 $\mu m^2$. This is followed by calculation of the area percentage (average percentage Av2 (area %)), with reference to the total area of the extracted region originating with the porous ferrite particle for the 50 magnetic carriers, for the total area provided by summing the areas of the individual regions assigned to 6.672 $\mu m^2$ (240 pixels) and above. Also calculated is the area percentage (average percentage Av3 (area %)), with reference to the total area of the extracted region originating with the porous ferrite particle for the 50 magnetic carriers, for the total area provided by summing the areas of the individual regions assigned to 2.780 $\mu m^2$ (100 pixels) and below.

<Method for Calculating the Average Value of the Areas of the Individual Regions Originating with the Porous Ferrite Particle>

The Ma referenced above is divided by the total number of regions in the 50 magnetic carriers to calculate the average value of the areas of the individual regions originating with the porous ferrite particle.

<Method for Measuring the Resistivity of the Magnetic Carrier and the Porous Ferrite Particle>

The resistivity of the magnetic carrier and porous ferrite particle is measured using the measurement apparatus described in FIG. 4. In the measurement on the porous ferrite particle, the measurement is carried out using a sample prior to resin filling and resin coating or a sample provided by removing, using the method described in the following, the filler resin and the coating resin from the magnetic carrier.

In the method for removing the filler resin and coating resin from the magnetic carrier, for example, the magnetic carrier is immersed in an organic solvent and specifically, for example, toluene or methyl ethyl ketone, and the filler resin and coating resin are dissolved under exposure to ultrasound. This is followed by sedimentation of the magnetic component using a magnet and recovery of the porous ferrite particles by eliminating the supernatant.

Figure 4A:
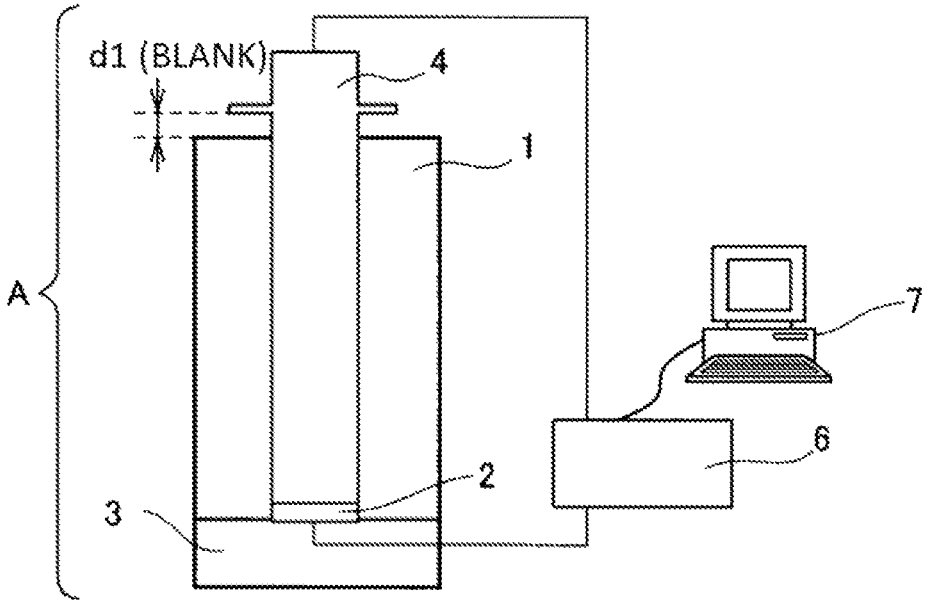
FIG. 4A is a diagram of the blank configuration prior to sample introduction and FIG. 4B is the configuration when the sample has been introduced.
Figure 4B:
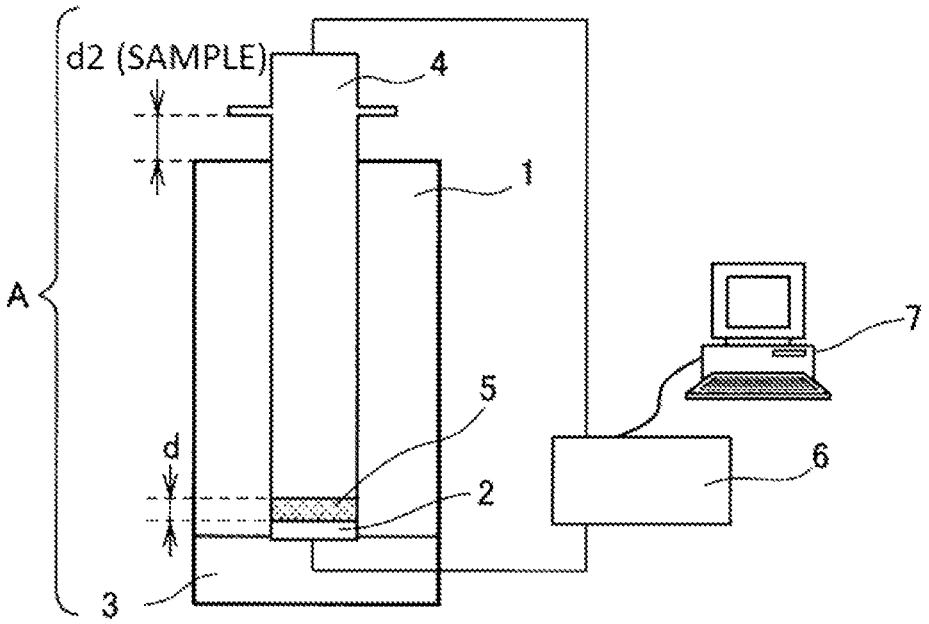

A resistance measurement cell A is composed of a cylindrical PTFE resin container 1 having an opening with a cross-sectional area of 2.4 $cm^2$, a lower electrode (stainless steel) 2, a support base (PTFE resin) 3, and an upper electrode (stainless steel) 4. The cylindrical PTFE resin container 1 is mounted on the support base 3; the sample (magnetic carrier or porous ferrite particle) 5 is filled to a thickness of approximately 1 mm; the upper electrode 4 is mounted on the filled sample 5; and the thickness of the sample is measured. The sample thickness d is then calculated using the following equation where d1 is the distance in the absence of the sample as shown in FIG. 4A and d2 is the distance when the sample has been filled to a thickness of approximately 1 mm as shown in FIG. 4B.

$$d=d2-d1$$

The filling volume of the sample may be varied at this time as appropriate so as to provide a sample thickness of from at least 0.95 mm to 1.04 mm.

The resistivity of the magnetic carrier and porous ferrite particle can be determined by applying a direct-current voltage between the electrodes and measuring the current that flows when this is done. An electrometer 6 (Keithley 6517A from Keithley Instruments Inc.) and a control computer 7 are used for the measurement.

Control software (LabVIEW from National Instruments Corporation) from National Instruments Corporation was utilized, which implements measurement to data processing.

The following are input for the measurement conditions: a contact area between the sample and electrode S=2.4 $cm^2$ and the actually measured value of d providing a sample thickness of from at least 0.95 mm to not more than 1.04 mm. In addition, the load of the upper electrode is set at 120 g and the maximum applied voltage is set at 1000 V.

With regard to the voltage application conditions, screening is performed by applying the following voltages for 1 second each using an IEEE-488 interface for control between the control computer and the electrometer, using auto range function of the electrometer: 1 V ($2^0$ V), 2 V ($2^1$ V), 4 V ($2^2$ V), 8 V ($2^3$ V), 16 V ($2^4$ V), 32 V ($2^5$ V), 64 V ($2^6$ V), 128 V ($2^7$ V), 256 V ($2^8$ V), 512 V ($2^9$ V), and 1000 V. During this process, the electrometer evaluates whether application is possible up to the maximum of 1000 V (for example, a field strength of 10000 V/cm when the sample thickness is 1.00 mm), and "VOLTAGE SOURCE OPERATE" flashes when an excess current flows. In this case, the instrument automatically determines the maximum value for the applied voltage by lowering the applied voltage and carrying out additional screening for the applicable voltage. The main measurement is then carried out. The individual voltage steps are obtained by dividing this maximum voltage value by 5, and the resistance value is measured from the current value after holding for 30 seconds. Taking, for example, the case in which the maximum applied voltage is 1000 V, the voltage is applied in an ascending and then descending sequence using a 200 V interval, which is ⅕ of the maximum applied voltage, of 200 V (first step), 400 V (second step), 600 V (third step), 800 V (fourth step), 1000 V (fifth step), 1000 V (sixth step), 800 V (seventh step), 600 V (eighth step), 400 V (ninth step), and 200 V (tenth step), and the resistance value is measured at each step from the current value after holding for 30 seconds.

An example of the measurement on a porous ferrite particle will now be described. The screening was performed first in the measurement, and, when voltages of 1 V ($2^0$ V), 2 V ($2^1$ V), 4 V ($2^2$ V), 8 V ($2^3$ V), 16 V ($2^4$ V), 32 V ($2^5$ V), 64 V ($2^6$ V), and 128 V ($2^7$ V) were applied for 1 second each, the "VOLTAGE SOURCE OPERATE" display was on up to and including 64 V and the "VOLTAGE SOURCE OPERATE" display flashed at 128 V. The maximum applicable voltage was approached with flashing at 90.5 V ($2^{6.5}$ V), on at 68.6 V ($2^{6.1}$ V), and flashing at 73.5 V ($2^{6.2}$ V), and a maximum applied voltage of 69.8 V was determined as a result. Voltages are then applied in the following sequence: 14.0 V (first step), which is the value that is one-fifth of 69.8 V; 27.9 V (second step), which is the value that is two-fifths; 41.9 V (third step), which is the value that is three-fifths; 55.8 V (fourth step), which is the value that is four-fifths; 69.8 V (fifth step), which is the value that is five-fifths; 69.8 V (sixth step); 55.8 V (seventh step); 41.9 V (eighth step); 27.9 V (ninth step); and 14.0 V (tenth step). The current values obtained here are processed by the computer and the resistivity and field strength are determined using a sample thickness of 0.97 mm and the electrode area and are plotted on a graph. In this case, the five points for the voltage descending from the maximum applied voltage are plotted. When in the measurements at the individual steps the "VOLTAGE SOURCE OPERATE" flashes and excess current is flowing, the resistance value is indicated by 0 for purposes of the measurement.

$$\text{resistivity}(\Omega\cdot\text{cm})=(\text{applied voltage(V)}/\text{measured current(A)})\times S(\text{cm}^2)/d(\text{cm})$$

$$\text{field strength(V/cm)}=\text{applied voltage(V)}/d(\text{cm})$$

Figure 5:
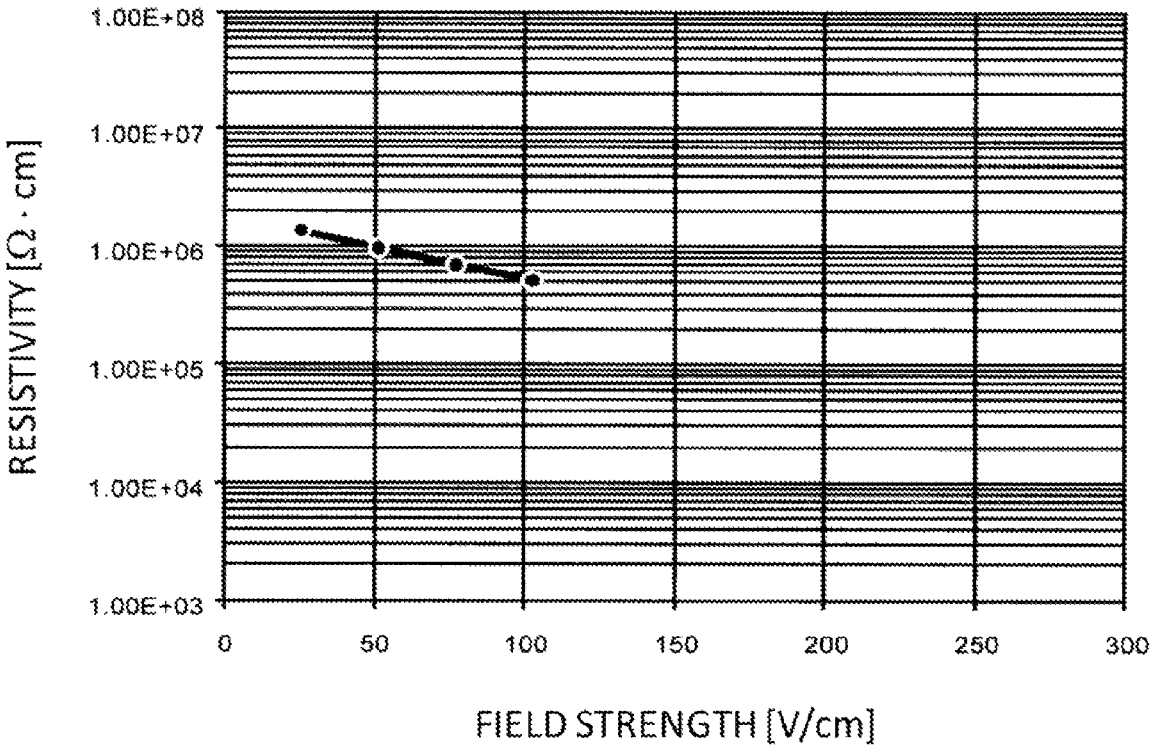
FIG. 5 shows an example of the resistivity measured, using the apparatus shown in FIG. 4, on the magnetic particles 1 used in Example 1.

For the resistivity of the porous ferrite particle at a field strength of 100 V/cm, the resistivity is read from the graph at a field strength of 100 V/cm on the graph. FIG. 5 shows the results for the plot for the porous ferrite particles (magnetic particles 1) used in Example 1 of the present invention. The resistivity at 100 V/cm is favorably read off in this measurement of the porous ferrite particle.

<Method for Measuring the 50% Particle Diameter (D50) on a Volume Basis of the Magnetic Carrier and Porous Ferrite Particles and Method for Measuring the 50% Particle Diameter (D50) on a Volume Basis of the Finely Pulverized Presintered Ferrite Product>

The particle diameter distribution was measured using a "Microtrac MT3300EX" (Nikkiso Co., Ltd.) laser diffraction scattering particle size distribution analyzer.

The measurement of the 50% particle diameter (D50) on a volume basis of the finely pulverized presintered ferrite product is carried out with a "Sample Delivery Control (SDC)" (Nikkiso Co., Ltd.) wet-type sample circulator installed. The finely pulverized presintered ferrite product (the ferrite slurry) is added dropwise to the sample circulator to give the measurement concentration. The following settings are used: flow rate=70%, ultrasound output=40 W, ultrasound time=60 seconds.

The measurement conditions are as follows.

SetZero time: 10 seconds
measurement time: 30 seconds
number of measurements: 10
solvent refractive index: 1.33
particle refractive index: 2.42
particle shape: nonspherical
measurement upper limit: 1408 μm
measurement lower limit: 0.243 μm
measurement environment: approximately 23° C./50% RH The measurement of the 50% particle diameter (D50) on a volume basis was carried out on the magnetic carrier and porous ferrite particle with a "Turbotrac One-Shot Dry Sample Conditioner" (Nikkiso Co., Ltd.) dry measurement sample feeder installed. The feed conditions with the Turbotrac were as follows: a dust collector was used as the vacuum source; the flow rate was approximately 33 L/sec; and the pressure was approximately 17 kPa. Control was carried out automatically with the software. The 50% particle diameter (D50) that is the cumulative value on a volume basis is determined for the particle diameter. Control and analysis are performed using the provided software (version 10.3.3-202D).

The measurement conditions are as follows.

SetZero time: 10 seconds
measurement time: 10 seconds
number of measurements: 1
particle refractive index: 1.81
particle shape: nonspherical
measurement upper limit: 1408 μm
measurement lower limit: 0.243 μm
measurement environment: approximately 23° C./50% RH <Measurement Method of the Weight-Average Particle Diameter (D4) of the Toner>

The weight-average particle diameter (D4) of the toner was calculated using a "Coulter Counter Multisizer 3" (registered trademark of Beckman Coulter, Inc.), which is a precision particle diameter distribution analyzer that uses the pore electrical resistance method and is equipped with a 100 μm aperture tube, and using the "Beckman Coulter Multisizer 3 Version 3.51" software (from Beckman Coulter, Inc.), for setting the measurement conditions and analyzing the measurement data, provided with the instrument, to perform measurements at 25000 channels for the number of effective measurement channels and to carry out analysis of the measurement data.

A solution of special-grade sodium chloride dissolved in ion-exchanged water and brought to a concentration of approximately 1 mass %, for example, "ISOTON II" (Beckman Coulter, Inc.), can be used for the aqueous electrolyte solution used for the measurement.

The dedicated software was set as follows prior to running the measurement and analysis. On the "Change Standard Operating Method (SOM)" screen of the dedicated software, the total count number for the control mode is set to 50000 particles, the number of measurements is set to 1, and the value obtained using "10.0 μm standard particles" (from Beckman Coulter, Inc.) is set for the Kd value. The threshold value and noise level are automatically set by pressing the threshold value/noise level measurement button. The current is set to 1600 μA, the gain is set to 2, the electrolyte solution is set to ISOTON II, and flush aperture tube after measurement is checked.

On the "pulse-to-particle diameter conversion setting" screen of the dedicated software, the bin interval is set to logarithmic particle diameter, the particle diameter bin is set to 256 particle diameter bins, and the particle diameter range is set to from at least 2 μm to not more than 60 μm.

The specific measurement method is as follows.

(1) Approximately 200 mL of the above-described aqueous electrolyte solution is introduced into the glass 250-mL roundbottom beaker provided for use with the Multisizer 3 and this is then set into the sample stand and counterclockwise stirring is performed with a stirring rod at 24 rotations per second. Dirt and bubbles in the aperture tube are removed using the "aperture flush" function of the analytic software.

(2) Approximately 30 mL of the above-described aqueous electrolyte solution is introduced into a glass 100-mL flatbottom beaker. To this is added the following as a dispersing agent: approximately 0.3 mL of a dilution prepared by diluting "Contaminon N" (a 10 mass % aqueous solution of a neutral pH 7 detergent for cleaning precision measurement instrumentation, comprising a nonionic surfactant, an anionic surfactant, and an organic builder, from Wako Pure Chemical Industries, Ltd.) three-fold on a mass basis with ion-exchanged water.

(3) A prescribed amount of ion-exchanged water is introduced into the water tank of an "Ultrasonic Dispersion System Tetora 150" ultrasound disperser (Nikkaki Bios Co., Ltd.), which has an output of 120 W and is equipped with two oscillators oscillating at 50 kHz and configured with a phase shift of 180°, and approximately 2 mL of the above-described Contaminon N is added to this water tank.

(4) The beaker from (2) is placed in the beaker holder of the ultrasound disperser and the ultrasound disperser is activated. The height position of the beaker is adjusted to provide the maximum resonance state for the surface of the aqueous electrolyte solution in the beaker.

(5) While exposing the aqueous electrolyte solution in the beaker of (4) to the ultrasound, approximately 10 mg of the toner is added in small portions to the aqueous electrolyte solution and is dispersed. The ultrasound dispersing treatment is continued for another 60 seconds. During ultrasound dispersion, the water temperature in the water tank is adjusted as appropriate to be at least 10° C. but no more than 40° C.

(6) Using a pipette, the aqueous electrolyte solution from (5) containing dispersed toner is added dropwise into the roundbottom beaker of (1) that is installed in the sample stand and the measurement concentration is adjusted to approximately 5%. The measurement is run until the number of particles measured reaches 50000.

(7) The measurement data is analyzed by the dedicated software provided with the instrument to calculate the weight-average particle diameter (D4). When the dedicated software is set to graph/volume %, the "average diameter" on the analysis/volume statistics (arithmetic average) screen is the weight-average particle diameter (D4).

<Method of Measuring the Binder Resin Peak Molecular Weight (Mp), Number-Average Molecular Weight (Mn), and Weight-Average Molecular Weight (Mw)>

The molecular weight distribution of the binder resin is measured by gel permeation chromatography (GPC) as follows.

The binder resin is dissolved in tetrahydrofuran (THF) over 24 hours at room temperature. The obtained solution is filtered using a "MYSHORI Disk" solvent-resistant membrane filter with a pore diameter of 0.2 μm (Tosoh Corporation) to obtain a sample solution. The sample solution is adjusted so as to provide a concentration of THF-soluble components of approximately 0.8 mass %. Measurement is performed under the following conditions using this sample solution.

instrument: HLC8120 GPC (detector: RI) (Tosoh Corporation)

columns: 7 column train of Shodex KF-801, 802, 803, 804, 805, 806, and 807 (Showa Denko KK)

eluent: tetrahydrofuran (THF)

flowrate: 1.0 mL/min oven temperature: 40.0° C.

sample injection amount: 0.10 mL

The sample molecular weight is determined using a molecular weight calibration curve constructed using standard polystyrene resin (for example, product name: "TSK Standard Polystyrene F-850, F-450, F-288, F-128, F-80, F-40, F-20, F-10, F-4, F-2, F-1, A-5000, A-2500, A-1000, A-500", from Tosoh Corporation).

<Measurement of the Peak Temperature of the Maximum Endothermic Peak of the Wax and of the Glass-Transition Temperature (Tg) of the Binder Resin>

The peak temperature of the maximum endothermic peak of the wax is measured based on ASTM D 3418-82 using a "Q1000" (TA Instruments) differential scanning calorimeter. The melting points of indium and zinc are used for temperature correction in the instrument's detection section, and the heat of fusion of indium is used to correct the amount of heat.

Specifically, approximately 10 mg of the wax is accurately weighed out and placed in an aluminum pan and the measurement is carried out at a ramp rate of 10° C./min in the measurement temperature range of 30 to 200° C. using an empty aluminum pan for reference. The measurement is performed by raising the temperature to 200° C., then lowering the temperature to 30° C., and thereafter raising the temperature once again. Peak temperature in the maximum endothermic peak in the DSC curve in this second temperature ramp-up step in the 30 to 200° C. temperature range is taken to be peak temperature in the maximum endothermic peak of the wax.

For the glass-transition temperature (Tg) of the binder resin, approximately 10 mg of the binder resin is accurately weighed out and measured in the same manner as for the measurement on the wax. When this is done the change in the specific heat in the temperature range from 40° C. to 100° C. is obtained. Here, the glass-transition temperature (Tg) of the binder resin is taken to be the intersection between the differential heat curve and the line for the midpoint between the baseline prior to the appearance of the specific heat change and the baseline after the appearance of the specific heat change.

<Method for Measuring the Number-Average Particle Diameter of the Primary Particles of the Inorganic Fine Particles>

The number-average particle diameter of the primary particles of the inorganic fine particles is measured using the following procedure.

The toner is submitted, without vapor deposition, to observation of the backscattered electron image using an S-4800 (Hitachi, Ltd.) scanning electron microscope and an acceleration voltage of 2.0 kV. The backscattered electron image is observed at 50000×. Contrast can be achieved between the inorganic fine particles and the organic material, e.g., the parent toner particle, due to the fact that the radiated amount of backscattered electrons depends on the atomic number of the materials constituting the sample. A particle of a component that is more highlighted (whiter) than the parent toner particle can be scored as an inorganic fine particle. 500 fine particles with diameters of at least 5 nm are randomly extracted. The major and minor diameters of the extracted particle are measured by digitization and the average value of the major and minor diameters is taken to be the particle diameter of the fine particle. For the particle diameter distribution (a histogram is used of columns in which the column widths are partitioned into 10 nm each, e.g., 5 to 15 nm, 15 to 25 nm, 25 to 35 nm, . . . ) of the extracted 500 particles, a histogram is constructed using the central value particle diameter of the columns and the number-average particle diameter is calculated.

<Method for Measuring the Intensity of Magnetization and the Residual Magnetization of the Magnetic Carrier and Porous Ferrite Particle>

The intensity of magnetization of the magnetic carrier and the porous ferrite particle is determined using a vibrating sample magnetometer or a direct-current magnetization property recording instrument (B-H tracer). In the examples given below, the measurement is carried out by the following procedure using a BHV-30 vibrating sample magnetometer (Riken Denshi Co., Ltd.).

The sample is prepared by filling sufficient magnetic carrier or porous ferrite particle tightly in a cylindrical plastic container. The actual mass is measured on the sample filled in this container. Using an instant glue, the sample in the plastic container is then bonded so the sample does not move. Using this reference sample, the external magnetic field axis and the magnetization moment axis are calibrated at 5000/4π (kA/m). The magnetization moment of the carrier filled in the container in this state is measured using a 5 min/loop sweep speed and applying an external magnetic field of 1000/4π (kA/m) (79.6 kA/m). In addition, the magnetization moment upon return to 0 kA/m from 79.6 kA/m is taken to be the residual magnetization. The actual mass of the carrier filled in the container is measured and the intensity of magnetization ($Am^2/kg$) and residual magnetization ($Am^2/kg$) of the magnetic carrier per unit mass at the time of application of the 79.6 kA/m external magnetic field is determined.

<Method for Measuring the Content of the Oxides of Mg, Sr, and Ca in the Porous Ferrite Particle>

The following procedure is used to measure the individual contents of the oxides of Mg, Sr, and Ca with reference to the mass of the porous ferrite particle.

The measurement is performed using the following analytical procedure and using an Axios Advanced (PANalytical B.V.) wavelength-dispersive x-ray fluorescence analyzer.

10 g of the porous ferrite particles is introduced into a 27-mm plastic measurement cup covered with 6-μm polypropylene film and the content of the oxides of Mg, Sr, and Ca in the porous ferrite particles is determined as MgO, SrO, and CaO using the following settings.

(Analytical Conditions)

quantitation method: fundamental parameter method (FP method)

elements analyzed: Na to U measurement atmosphere: He measurement sample: powder collimator mask diameter: 27 mm measurement conditions: An automatic program is used that has been preset to the optimal excitation conditions for each element.

measurement time: 15 minutes

Otherwise, the general values recommended by the instrument are used.

(Data Analysis)

data analysis program: UniQuant5 data analysis conditions: oxide morphology, no balance component (standardized for the detected element)

Otherwise, the general values recommended by the instrument are used.

<Method of Measuring the Coverage Ratio by the Inorganic Fine Particles of the Toner Particles>

The following method is used to measure the coverage ratio of the toner particles by the inorganic fine particles having a number-average primary particle diameter of from at least 60 nm to not more than 300 nm.

The coverage ratio can be determined by observation of the backscattered electron image of the toner using a scanning electron microscope followed by image processing. Specifically, the determination is made by image processing of the projection image that visualizes the backscattered electrons and is obtained using an S-4800 (Hitachi, Ltd.) scanning electron microscope (SEM) at an acceleration voltage of 2.0 kV. First, the projection image visualizing the backscattered electrons is obtained for 50 toner particles at a magnification of 20000×. Then, a region corresponding to width 4 μm×2 μm is cropped out from the center of the image and the approximately spherical inorganic fine particles having an average diameter in the specified range are manually selected on the image in the cropped range and each of their areas is determined. The areas of all the inorganic fine particles on the image in the cropped range are summed and the ratio of the inorganic fine particles relative to the area of the cropped range is calculated. The image processing is performed by cropping the specified range from the center of the image because the edges of the image may not be in focus due to the shape of the toner and the determination of an accurate coverage ratio at image locations that are in focus is desired. Image-Pro Plus 5.1J image processing software (Media Cybernetics Inc.) is used for the coverage ratio by the inorganic fine particles of the toner particles.

EXAMPLES

The present invention is more specifically explained with reference to examples below, but the present invention is not limited to only these examples. Unless specifically indicated otherwise, the number of parts and % in the examples and comparative examples are on a mass basis in all instances.

<Production Example for Magnetic Particle 1 (Porous Ferrite Particle)>

| [Step 1 (Weighing/mixing step)] | |
|---|---|
| $Fe_2O_3$ | 91.6 weight % |
| $Mg(OH)_2$ | 7.2 weight % |
| $SrCO_3$ | 0.7 weight % |
| $CaCO_3$ | 0.5 weight % |

The ferrite starting materials were weighed out so the preceding materials were in the compositional ratio given above. This was followed by pulverization/mixing for 3 hours with a dry ball mill using stainless steel balls having a diameter of 10 mm.

[Step 2 (Presintering Step)]

After pulverization mixing, the starting materials were sintered for 6 hours in air at a temperature of 950° C. using a rotary sintering furnace to produce a presintered ferrite. The composition of the obtained presintered ferrite is given below.

$$(MgO)_a(SrO)_b(CaO)_c(Fe_2O_3)_d$$

[In the preceding formula, a=0.174, b=0.007, c=0.007, and d=0.812.]

[Step 3 (Pulverization Step)]

After pulverization of the obtained presintered ferrite to approximately 0.5 mm with a crusher, a ferrite slurry (finely pulverized presintered ferrite product) was obtained by carrying out pulverization for hours with a wet bead mill using stainless steel beads with a diameter of 1.5 mm and adding 30 mass parts of water to each 100 mass parts of the presintered ferrite. When the particle diameter of the primary particles of the obtained finely pulverized presintered ferrite product was analyzed with a Microtrac MT3300EX (Nikkiso Co., Ltd.), the 50% particle diameter (D50) on a volume basis was 2.2 μm.

[Step 4 (Granulating Step)]

2.0 mass parts of a polyvinyl alcohol was added to the ferrite slurry as a binder for each 100 mass parts of the presintered ferrite, and granulation into spherical particles was carried out using a spray dryer (manufacturer: Ohkawara Kakohki Co., Ltd.). This was followed by heating for 2 hours at up to 750° C. in air using a rotary electric furnace to remove the organic compounds, e.g., the binder resin and additives.

[Step 5 (Main Sintering Step)]

In order to control the sintering atmosphere, sintering was run using a rotary sintering furnace under a nitrogen atmosphere (0.01 volume % oxygen concentration). More particularly, the temperature was raised at a rate of 120° C./hour and, after holding for 6 hours at 1050° C., the temperature was reduced to room temperature at a rate of 100° C./hour.

[Step 6 (Classification Step)]

After the aggregated particles had been broken up, the coarse particles were removed by sieving with a sieve having an aperture of 250 μm to obtain a magnetic particle 1. This magnetic particle 1 had a 50% particle diameter (D50) on a volume basis of 38.5 μm and a resistivity at 100 V/cm of $5.1\times10^5$ Ω·cm. The properties of magnetic particle 1 are given in Table 2.

<Magnetic Particle 2 to Magnetic Particle 29 Production Example>

Magnetic particles 2 to 29 were produced proceeding as in the Magnetic Particle 1 Production Example, but adjusting as appropriate to the conditions in each of the presintering, pulverization, and sintering steps as shown in Table 1 according to the starting material blending ratios given in Table 1. The properties of the obtained magnetic particles are shown in Table 2.

TABLE 1

| magnetic | starting material blending raize | | | | | presintering step | |
|---|---|---|---|---|---|---|---|
| | | | | | | presintering | |
| particle No. | $Fe_2O_3$ (mass %) | $Mg(CH)_2$ (mass %) | $MnCO_3$ (mass %) | $SrCO_3$ (mass %) | $CaCO_3$ (mass %) | temperatures and time | atmosphere |
| 1 | 91.8 | 7.2 | — | 0.7 | 0.5 | 950° C. 6 hours | in air |
| 2 | 91.8 | 7.2 | — | 0.7 | 0.5 | 950° C. 6 hours | in air |
| 3 | 91.8 | 7.2 | — | 0.7 | 0.5 | 950° C. 6 hours | in air |
| 4 | 91.8 | 7.2 | — | 0.7 | 0.5 | 950° C. 6 hours | in air |

TABLE 1-continued

| | | | | | | | |
|---|---|---|---|---|---|---|---|
| 5 | 91.8 | 7.2 | — | 0.7 | 0.5 | 950° C. 6 hours | in air |
| 6 | 91.8 | 7.2 | — | 0.7 | 0.5 | 950° C. 6 hours | in air |
| 7 | 91.9 | 7.2 | — | 0.5 | 0.3 | 950° C. 6 hours | in air |
| 8 | 89.9 | 7.0 | — | 1.7 | 1.4 | 950° C. 6 hours | in air |
| 9 | 92.2 | 7.2 | — | 0.2 | 0.2 | 950° C. 6 hours | in air |
| 10 | 88.3 | 9.0 | — | 2.2 | 1.0 | 950° C. 6 hours | in air |
| 11 | 92.9 | 8.8 | — | 0.2 | 0.1 | 950° C. 6 hours | in air |
| 12 | 90.8 | 5.3 | — | 2.0 | 2.0 | 950° C. 6 hours | in air |
| 13 | 83.3 | 12.2 | — | 2.0 | 1.0 | 950° C. 6 hours | in air |
| 14 | 95.8 | 3.8 | — | 0.2 | 0.1 | 950° C. 6 hours | in air |
| 15 | 89.3 | 12.8 | — | 2.1 | 1.0 | 950° C. 6 hours | in air |
| 16 | 98.0 | 1.6 | — | 0.2 | 0.2 | 950° C. 6 hours | in air |
| 17 | 79.8 | 16.3 | | 2.1 | 1.0 | 950° C. 6 hours | in air |
| 18 | 97.3 | 2.3 | — | 2.3 | 0.1 | 950° C. 6 hours | in air |
| 19 | 77.5 | 16.7 | — | 2.0 | 1.8 | 950° C. 6 hours | in air |
| 20 | 80.1 | 4.5 | 34.5 | 0.8 | — | 950° C. 2 hours | in air |
| 21 | 79.8 | 18.3 | 0.3 | — | — | 1050° C. 7 hours | in air |
| | | | | | | 1150° C. 6 hours | |
| 22 | 93.7 | 5.8 | — | 0.5 | — | 800° C. 3 hours | in air |
| | | | | | | 950° C. 2 hours | reducing atmosphere |
| 23 | 95.0 | 2.1 | — | 1.1 | 1.0 | 950° C. 6 hours | in air |
| 24 | 89.1 | 13.4 | 1.6 | 1.0 | 0.0 | 950° C. 6 hours | in air |
| 25 | 97.3 | 1.2 | — | 0.0 | 0.0 | 950° C. 6 hours | in air |
| 26 | 73.5 | 20.7 | 4.4 | 0.0 | 0.0 | 950° C. 6 hours | in air |
| 27 | 84.8 | 13.8 | — | — | 1.4 | 950° C. 6 hours | in air |
| 28 | 95.2 | 4.0 | — | 0.1 | 0.1 | 950° C. 6 hours | in air |
| 29 | 90.7 | 4.4 | — | 3.4 | 1.5 | 950° C. 6 hours | in air |

| | pulverization step | | | |
|---|---|---|---|---|
| magnetic particle No. | pulverization conditions | best configuration | pulverization time | pulverization particle diameter D50 (μm) |
| 1 | wet | 1.5 mm stainless steel beads | 8 hours | 2.2 |
| 2 | wet | 1.5 mm stainless steel beads | 8 hours | 1.8 |
| 3 | wet | 1.5 mm stainless steel beads | 8 hours | 2.1 |
| 4 | wet | 1.5 mm stainless steel beads | 10 hours | 1.3 |
| 5 | wet | 1.5 mm stainless steel beads | 5 hours | 2.5 |
| 6 | wet | 1.5 mm stainless steel beads | 4 hours | 2.8 |
| 7 | wet | 1.5 mm stainless steel beads | 8 hours | 1.8 |
| 8 | wet | 1.5 mm stainless steel beads | 8 hours | 1.8 |
| 9 | wet | 1.5 mm stainless steel beads | 8 hours | 1.8 |
| 10 | wet | 1.5 mm stainless steel beads | 8 hours | 1.8 |
| 11 | wet | 1.5 mm stainless steel beads | 8 hours | 1.8 |
| 12 | wet | 1.5 mm stainless steel beads | 8 hours | 1.8 |
| 13 | wet | 1.5 mm stainless steel beads | 8 hours | 1.8 |
| 14 | wet | 1.5 mm stainless steel beads | 8 hours | 1.8 |
| 15 | wet | 1.5 mm stainless steel beads | 8 hours | 1.8 |
| 16 | wet | 1.5 mm stainless steel beads | 8 hours | 1.8 |
| 17 | wet | 1.5 mm stainless steel beads | 8 hours | 1.8 |
| 18 | wet | 1.5 mm stainless steel beads | 8 hours | 1.9 |
| 19 | wet | 1.5 mm stainless steel beads | 8 hours | 2.0 |
| 20 | wet | 1.0 mm zirconic beads | 4 hours | 2.8 |
| 21 | wet | 1.5 mm stainless steel beads | 10 hours | 1.2 |
| | wet | 1.5 mm stainless steel beads | 4 hours | 5.5 |
| 22 | dry | 1/8 stainless steel beads | 2 hours | 1.6 |
| | wet | 1/16 stainless steel beads | 4 hours | |
| 23 | wet | 1.5 mm stainless steel beads | 8 hours | 1.0 |
| 24 | wet | 1.5 mm stainless steel beads | 8 hours | 1.8 |
| 25 | wet | 1.5 mm stainless steel beads | 8 hours | 1.8 |
| 26 | wet | 1.5 mm stainless steel beads | 8 hours | 1.8 |
| 27 | wet | 1.5 mm stainless steel beads | 8 hours | 1.8 |
| 28 | wet | 1.5 mm stainless steel beads | 8 hours | 1.8 |
| 29 | wet | 1.5 mm stainless steel beads | 8 hours | 1.8 |

| | sintering step | | | | | |
|---|---|---|---|---|---|---|
| magnetic particle No. | presintering heat treatment | atmosphere | ramp-up rate | main sintering | ramp-down rate | atmosphere oxygen concentration |
| 1 | 750° C. 2 hours | in air | 120° C./hr | 1050° C. 6 hours | 100° C./hr | 0.01% |
| 2 | 750° C. 2 hours | in air | 120° C./hr | 1050° C. 6 hours | 100° C./hr | 0.01% |
| 3 | 750° C. 2 hours | in air | 120° C./hr | 1050° C. 6 hours | 100° C./hr | 0.01% |
| 4 | 750° C. 2 hours | in air | 120° C./hr | 1050° C. 6 hours | 100° C./hr | 0.01% |
| 5 | 750° C. 2 hours | in air | 120° C./hr | 1050° C. 6 hours | 100° C./hr | 0.01% |
| 6 | 750° C. 2 hours | in air | 120° C./hr | 1050° C. 6 hours | 100° C./hr | 0.01% |

TABLE 1-continued

| | | | | | | |
|---|---|---|---|---|---|---|
| 7 | 750° C. 2 hours | in air | 120° C./hr | 1050° C. 6 hours | 100° C./hr | 0.01% |
| 8 | 750° C. 2 hours | in air | 120° C./hr | 1050° C. 6 hours | 100° C./hr | 0.01% |
| 9 | 750° C. 2 hours | in air | 120° C./hr | 1050° C. 6 hours | 100° C./hr | 0.01% |
| 10 | 750° C. 2 hours | in air | 120° C./hr | 1050° C. 6 hours | 100° C./hr | 0.01% |
| 11 | 750° C. 2 hours | in air | 120° C./hr | 1050° C. 6 hours | 100° C./hr | 0.01% |
| 12 | 750° C. 2 hours | in air | 120° C./hr | 1050° C. 6 hours | 100° C./hr | 0.01% |
| 13 | 750° C. 2 hours | in air | 120° C./hr | 1050° C. 6 hours | 100° C./hr | 0.01% |
| 14 | 750° C. 2 hours | in air | 120° C./hr | 1050° C. 6 hours | 100° C./hr | 0.01% |
| 15 | 750° C. 2 hours | in air | 120° C./hr | 1050° C. 6 hours | 100° C./hr | 0.01% |
| 16 | 750° C. 2 hours | in air | 120° C./hr | 1050° C. 6 hours | 100° C./hr | 0.01% |
| 17 | 750° C. 2 hours | in air | 120° C./hr | 1050° C. 6 hours | 100° C./hr | 0.01% |
| 18 | 750° C. 2 hours | in air | 120° C./hr | 1050° C. 6 hours | 100° C./hr | 0.01% |
| 19 | 750° C. 2 hours | in air | 120° C./hr | 1050° C. 6 hours | 100° C./hr | 0.20% |
| 20 | 750° C. 2 hours | in air | 150° C./hr | 1050° C. 4 hours | 120° C./hr | 0.01% |
| 21 | 900° C. 12 hours | in air | 150° C./hr | 1200° C. 4 hours | 120° C./hr | 2.00% |
| 22 | 700° C. 2 hours | in air | 150° C./hr | 1050° C. 5 hours | 120° C./hr | nitrogen atmosphere |
| 23 | 750° C. 2 hours | in air | 120° C./hr | 1050° C. 6 hours | 100° C./hr | reducing atmosphere |
| 24 | 750° C. 2 hours | in air | 120° C./hr | 1050° C. 6 hours | 100° C./hr | 0.01% |
| 25 | 750° C. 2 hours | in air | 120° C./hr | 1050° C. 6 hours | 100° C./hr | 0.01% |
| 26 | 750° C. 2 hours | in air | 120° C./hr | 1050° C. 6 hours | 100° C./hr | 0.01% |
| 27 | 750° C. 2 hours | in air | 120° C./hr | 1050° C. 6 hours | 100° C./hr | 0.01% |
| 28 | 750° C. 2 hours | in air | 120° C./hr | 1050° C. 6 hours | 100° C./hr | 0.20% |
| 29 | 750° C. 2 hours | in air | 120° C./hr | 1050° C. 6 hours | 100° C./hr | 0.01% |

TABLE 2

| | composition | | | | | content of Mg oxide as MgO (mass %) | total content of Sr oxide and Ca oxide as an SrO and CaO (mass %) | particle diameter D50 [μm] | pore diameter [μm] | resistivity [Ω · cm] | residual magnetization [$Am^2/kg$] |
|---|---|---|---|---|---|---|---|---|---|---|---|
| magnetic particle 1 | (MgO) | 0.174 (SrO) | 0.007 (CaO) | 0.007 ($Fe_2O_3$) | 0.812 | 5.09% | 0.83% | 38.5 | 0.8 | $5.1 \times 10^6$ | 1 |
| magnetic particle 2 | (MgO) | 0.174 (SrO) | 0.007 (CaO) | 0.007 ($Fe_2O_3$) | 0.812 | 5.09% | 0.83% | 37.5 | 0.4 | $5.1 \times 10^6$ | 2 |
| magnetic particle 3 | (MgO) | 0.174 (SrO) | 0.007 (CaO) | 0.007 ($Fe_2O_3$) | 0.812 | 5.09% | 0.83% | 38.5 | 1.2 | $5.1 \times 10^6$ | 1 |
| magnetic particle 4 | (MgO) | 0.174 (SrO) | 0.007 (CaO) | 0.007 ($Fe_2O_3$) | 0.812 | 5.09% | 0.83% | 38.8 | 0.3 | $5.1 \times 10^6$ | 3 |
| magnetic particle 5 | (MgO) | 0.174 (SrO) | 0.007 (CaO) | 0.007 ($Fe_2O_3$) | 0.812 | 5.09% | 0.83% | 39.0 | 1.3 | $5.1 \times 10^6$ | 1 |
| magnetic particle 6 | (MgO) | 0.174 (SrO) | 0.007 (CaO) | 0.007 ($Fe_2O_3$) | 0.812 | 5.09% | 0.83% | 42.5 | 1.5 | $5.1 \times 10^6$ | 1 |
| magnetic particle 7 | (MgO) | 0.175 (SrO) | 0.005 (CaO) | 0.005 ($Fe_2O_3$) | 0.815 | 5.10% | 0.57% | 38.8 | 0.6 | $3.0 \times 10^5$ | 2 |
| magnetic particle 8 | (MgO) | 0.170 (SrO) | 0.016 (CaO) | 0.020 ($Fe_2O_3$) | 0.794 | 5.03% | 2.05% | 37.7 | 1.2 | $6.5 \times 10^5$ | 1 |
| magnetic particle 9 | (MgO) | 0.174 (SrO) | 0.003 (CaO) | 0.004 ($Fe_2O_3$) | 0.819 | 5.07% | 0.40% | 36.9 | 0.5 | $2.8 \times 10^5$ | 4 |
| magnetic particle 10 | (MgO) | 0.228 (SrO) | 0.020 (CaO) | 0.022 ($Fe_2O_3$) | 0.730 | 7.12% | 2.56% | 38.2 | 1.2 | $7.5 \times 10^5$ | 1 |
| magnetic particle 11 | (MgO) | 0.166 (SrO) | 0.002 (CaO) | 0.002 ($Fe_2O_3$) | 0.830 | 4.80% | 0.22% | 38.5% | 0.4 | $2.6 \times 10^5$ | 4 |
| magnetic particle 12 | (MgO) | 0.131 (SrO) | 0.020 (CaO) | 0.030 ($Fe_2O_3$) | 0.820 | 3.78% | 2.64% | 38.5 | 1.3 | $7.6 \times 10^5$ | 3 |
| magnetic particle 13 | (MgO) | 0.274 (SrO) | 0.018 (CaO) | 0.025 ($Fe_2O_3$) | 0.684 | 8.93% | 2.61% | 38.4 | 1.2 | $9.0 \times 10^5$ | 1 |
| magnetic particle 14 | (MgO) | 0.099 (SrO) | 0.002 (CaO) | 0.002 ($Fe_2O_3$) | 0.897 | 2.70% | 0.22% | 38.4 | 0.4 | $2.5 \times 10^5$ | 5 |
| magnetic particle 15 | (MgO) | 0.284 (SrO) | 0.018 (CaO) | 0.024 ($Fe_2O_3$) | 0.674 | 9.38% | 2.62% | 38.9 | 1.3 | $9.2 \times 10^5$ | 1 |
| magnetic particle 16 | (MgO) | 0.043 (SrO) | 0.002 (CaO) | 0.003 ($Fe_2O_3$) | 0.952 | 1.13% | 0.25% | 39.2 | 0.5 | $1.8 \times 10^5$ | 4 |
| magnetic particle 17 | (MgO) | 0.345 (SrO) | 0.017 (CaO) | 0.022 ($Fe_2O_3$) | 0.616 | 12.06% | 2.63% | 39.0 | 1.4 | $1.2 \times 10^5$ | 1 |

TABLE 2-continued

| | composition | | | | | | content of Mg oxide as MgO (mass %) | total content of Sr oxide and Ca oxide as an SrO and CaO (mass %) | particle diameter D50 [μm] | pore diameter [μm] | resistivity [Ω · cm] | residual magnetization [$Am^2$/kg] |
|---|---|---|---|---|---|---|---|---|---|---|---|---|
| magnetic particle 18 | | (MgO) | 0.060 (SrO) | 0.003 (CaO) | 0.001 ($Fe_2O_3$) | 0.936 | 1.65% | 0.27% | 38.4 | 0.6 | $9.0 \times 10^4$ | 4 |
| magnetic particle 19 | | (MgO) | 0.382 (SrO) | 0.016 (CaO) | 0.022 ($Fe_2O_3$) | 0.579 | 13.90% | 2.63% | 36.8 | 1.5 | $4.8 \times 10^8$ | 1 |
| magnetic particle 20 | (MnO) | 0.395 (MgO) | 0.101 (SrO) | 0.008 | ($Fe_2O_3$) | 0.496 | 3.64% | 0.72% | 38.5 | 1.0 | $3.0 \times 10^7$ | 1 |
| magnetic particle 21 | (MnO) | 0.011 (MgO) | 0.394 | | ($Fe_2O_3$) | 0.595 | 14.22% | 0.00% | 36.1 | — | $5.5 \times 10^8$ | 1 |
| magnetic particle 22 | | (MgO) | 0.146 (SrO) | 0.005 | ($Fe_2O_3$) | 0.849 | 4.14% | 0.33% | 35.8 | 0.5 | $1.0 \times 10^7$ | 5 |
| magnetic particle 23 | | (MgO) | 0.055 (SrO) | 0.011 (CaO) | 0.015 ($Fe_2O_3$) | 0.919 | 1.47% | 1.30% | 38.8 | 0.4 | $6.0 \times 10^4$ | 4 |
| magnetic particle 24 | (MnO) | 0.017 (MgO) | 0.294 (SrO) | 0.009 (CaO) | 0.012 ($Fe_2O_3$) | 0.668 | 9.76% | 1.30% | 37.5 | 1.3 | $6.5 \times 10^8$ | 2 |
| magnetic particle 25 | | (MgO) | 0.032 (SrO) | 0.009 (CaO) | 0.009 ($Fe_2O_3$) | 0.949 | 0.83% | 0.98% | 37.0 | 0.3 | $3.5 \times 10^6$ | 5 |
| magnetic particle 26 | (MnO) | 0.044 (MgO) | 0.410 (SrO) | 0.007 (CaO) | 0.007 ($Fe_2O_3$) | 0.532 | 16.42% | 1.04% | 39.2 | 1.6 | $8.5 \times 10^6$ | 1 |
| magnetic particle 27 | | (MgO) | 0.302 | (CaO) | 0.018 ($Fe_2O_3$) | 0.680 | 10.00% | 0.83% | 38.0 | 1.4 | $5.0 \times 10^5$ | 2 |
| magnetic particle 28 | | (MgO) | 0.117 (SrO) | 0.001 (CaO) | 0.001 ($Fe_2O_3$) | 0.881 | 3.25% | 0.11% | 37.2 | 1.0 | $1.2 \times 10^5$ | 3 |
| magnetic particle 29 | | (MgO) | 0.111 (SrO) | 0.033 (CaO) | 0.022 ($Fe_2O_3$) | 0.833 | 3.15% | 3.30% | 36.5 | 1.0 | $5.0 \times 10^5$ | 3 |

<Resin-Filled Core Particle 1 Production Example>

A filler resin 1 (solution) was prepared by mixing a silicone resin (SR-2411, Dow Corning Toray Co., Ltd., resin solids fraction=20 mass %) as the filler resin with 5 mass parts of γ-aminopropyltriethoxysilane for each 100 mass parts of the silicone resin solids fraction. 100 mass parts of magnetic particle 1 was introduced into a mixer/stirrer and was heated to a temperature of 50° C. under reduced pressure. The filler resin 1 solution, corresponding to 7.0 mass parts as the filler resin component for each 100 mass parts of magnetic particle 1, was added dropwise over 2 hours and stirring was performed for an additional 1 hour at 50° C. The temperature was then raised to 80° C. and the solvent component was completely removed. The resulting sample was transferred into a mixer equipped with a spiral paddle in a rotatable mixing vessel (Drum Mixer Model UD-AT from Sugiyama Heavy Industrial Co., Ltd.) and was heat-treated for 2 hours at a temperature of 200° C. under a nitrogen atmosphere. Classification with a mesh having an aperture of 70 μm yielded a resin-filled core particle 1 (also referred to as filled core 1 in the following).

<Resin-Filled Core Particles 2 to 28 Production Example>

Resin-filled core particles 2 to 28 were obtained proceeding as in the Resin-Filled Core Particle 1 Production Example, but adjusting the amount of resin filled into the magnetic particles given in Table 3 to provide the amount of resin fill shown in Table 3.

<Coating Resin 1 (Solution) Production Example>

As the monomer component forming the main chain, 50 mass parts of cyclohexyl methacrylate (CHMA) and 50 mass parts of methyl methacrylate (MMA) were introduced into a four-neck flask having a reflux condenser, thermometer, nitrogen intake tube, and a ground-glass-type stirrer. 90 mass parts of toluene, 110 mass parts of methyl ethyl ketone, and 2.0 mass parts of azobisisovaleronitrile were also added. The obtained mixture was held for 10 hours at 70° C. under a nitrogen current to carry out a polymerization reaction. After the completion of the polymerization reaction, the reaction solution was added dropwise to five-fold methanol to effect precipitation; the solids were removed by decantation; and a solid copolymer with a weight-average molecular weight (Mw) of 76000 was obtained by repeated washing with methanol, filtration, and drying. 30 mass parts of the obtained solid copolymer was dissolved in 40 mass parts of toluene and 30 mass parts of methyl ethyl ketone to prepare a resin solution (30 mass % resin solids fraction).

| | |
|---|---|
| the aforementioned resin solution (30 mass % resin solids fraction) | 100 mass parts |
| carbon black (DBP absorption [150 mL/100 g]) | 1.5 mass parts |
| toluene | 200 mass parts |
| methyl ethyl ketone | 30 mass parts |

These components were introduced into a sand mill along with glass beads having a diameter of 1.00 mm and were dispersed for 1 hour at 1000 rpm to produce a coating resin solution 1 having a resin solids fraction concentration of 10 mass %.

<Coating Resin 2 (Solution) Production Example>

| | |
|---|---|
| styrene-methyl methacrylate copolymer (St/MMA (mass ratio) = 80/20, weight-average molecular weight = $8.0 \times 10^4$) | 30 mass parts |
| carbon black (DBP absorption 110 mL/100 g) | 3 mass parts |

-continued

| | |
|---|---|
| toluene | 200 mass parts |
| methyl ethyl ketone | 100 mass parts |

These components were introduced into a sand mill along with glass beads and were dispersed for 1 hour at 1000 rpm to produce a coating resin solution 2 having a resin solids fraction concentration of 10 mass %.

<Coating Resin 3 (Solution) Production Example>

| | |
|---|---|
| silicone resin (SR2411 from Dow Corning Toray Co., Ltd., 20 mass % resin solids fraction) | 50 mass parts |
| γ-aminopropyltriethoxysilane | 1 mass part |
| carbon black (DBP absorption 110 mL/100 g) | 1 mass part |
| toluene | 50 mass parts |

These components were introduced into a sand mill along with glass beads and were dispersed for 1 hour at 1000 rpm to produce a coating resin solution 3 having a resin solids fraction concentration of 10 mass %.

<Coating Resin 4 (Solution) Production Example>

| | |
|---|---|
| silicone resin (SR2411 from Dow Corning Toray Co., Ltd., 20 mass % resin solids fraction) | 50 mass parts |
| γ-aminopropyltriethoxysilane | 1 mass part |
| toluene | 50 mass parts |

These components were introduced into a sand mill along with glass beads and were dispersed for 1 hour at 1000 rpm to produce a coating resin solution 4 having a resin solids fraction concentration of 10 mass %.

<Magnetic Carrier 1 Production Example>

1.0 mass part of coating resin solution 1 was introduced into a vacuum degassing kneader per 100 mass parts of resin-filled core particle 1. Mixing was continued without change for 15 minutes at 30 rpm and the temperature was then raised and the pressure was lowered to 80° C. and 0.10 MPa and a solvent removal and coating operation was run while mixing for 30 minutes at 30 rpm (first stage). The resulting treated particles were confirmed to be in a powder state; stirring was continued while returning to atmospheric pressure; and the coating resin 1 solution was added so as to provide 1.0 mass part of the coating resin component with reference to the resin-filled core particle 1. The temperature was raised and the pressure was lowered to 80° C. and 0.10 MPa and while continuing blending at 30 rpm for 30 minutes a second-stage solvent removal and coating operation was similarly performed. After this, stirring was continued and the temperature was reduced to room temperature and the obtained sample was transferred into a mixer equipped with a spiral paddle in a rotatable mixing vessel (Drum Mixer Model UD-AT from Sugiyama Heavy Industrial Co., Ltd.) and was heat-treated for 1 hour at a temperature of 80° C. under a nitrogen atmosphere. This was followed by magnetic separation and classification with a mesh having an aperture of 70 μm to obtain a magnetic carrier 1. The properties of the obtained magnetic carrier 1 are shown in Table 4.

<Magnetic Carriers 2 to 5, 7, 9, 11, 13, and 22 Production Example>

The resin-filled core particles of Table 3 were respectively introduced into a vacuum degassing kneader and a coating operation was performed as in the Magnetic Carrier 1 Production Example on each resin-filled core particle using the coating resin, amount of coating, and number of coatings shown in Table 3. After the completion of the coating operation, removal and a heat treatment for 1 hour at a temperature of 80° C. under a nitrogen atmosphere were performed as in the Magnetic Carrier 1 Production Example. This was followed by magnetic separation and classification with a mesh having an aperture of 70 μm to obtain the magnetic carrier. The properties of the obtained magnetic carriers are given in Table 4.

<Magnetic Carrier 6 Production Example>

Using coating resin solution 1 so as to provide 2.0 mass parts of the coating resin component for 100 mass parts of resin-filled core particle 4, a coating operation and solvent removal were carried out using a fluidized bed heated to 80° C. This was followed by transfer into a mixer equipped with a spiral paddle in a rotatable mixing vessel (Drum Mixer Model UD-AT from Sugiyama Heavy Industrial Co., Ltd.) and heat treatment for 2 hours at a temperature of 80° C. under a nitrogen atmosphere. This was followed by magnetic separation and classification with a mesh having an aperture of 70 μm to obtain a magnetic carrier 6. The properties of the obtained magnetic carrier 6 are shown in Table 4.

<Magnetic Carriers 8, 10, and 12 Production Example>

Proceeding as for magnetic carrier 6, a coating operation and solvent removal were performed using a fluidized bed heated to 80° C., but using the coating resin shown in Table 3 so as to provide the specified coating amount with respect to the resin-filled core particle shown in Table 3. The completion of the coating operation was followed by heat treatment as in the Magnetic Carrier 6 Production Example and magnetic separation and classification with a mesh having an aperture of 70 μm. The properties of the obtained magnetic carriers are given in Table 4.

<Magnetic Carrier 14 Production Example>

100 mass parts of resin-filled core particle 13 was introduced into a mixer (Nauta Mixer Model VN from Hosokawa Micron Corporation) and adjustment to a temperature of 70° C. under reduced pressure was carried out while stirring at a screw rotation rate of 100 $min^{-1}$ and a revolution rate of 3.5 $min^{-1}$. Coating resin solution 1 was introduced so as to provide 1.0 mass part of the coating resin component with respect to 100 mass parts of resin-filled core particle 13. Solvent removal and a coating operation were run over 2 hours. This was followed by transfer into a mixer equipped with a spiral paddle in a rotatable mixing vessel (Drum Mixer Model UD-AT from Sugiyama Heavy Industrial Co., Ltd.) and heat treatment for 2 hours at a temperature of 80° C. under a nitrogen atmosphere. This was followed by magnetic separation and classification with a mesh having an aperture of 70 μm to obtain a magnetic carrier 14. The properties of the obtained magnetic carrier 14 are shown in Table 4.

<Magnetic Carriers 15 to 21 and 24 to 30 Production Example>

Proceeding as in the Magnetic Carrier 14 Production Example with the resin-filled core particle shown in Table 3, a coating operation and solvent removal were performed using the coating resin shown in Table 3 at the specified coating amount and number of coatings. With the exception of magnetic carrier 21, the completion of the coating operation was followed by heat treatment as in the Magnetic Carrier 14 Production Example and magnetic separation and classification with a mesh having an aperture of 70 μm. In the case of magnetic carrier 21, the same treatment was performed after the completion of the coating operation, but carrying out the heat treatment for 2 hours at 200° C. The properties of the obtained magnetic carriers are given in Table 4.

<Magnetic Carrier 23 Production Example>

With the exception that a Versatile Mixer was used for the coating apparatus, a coating operation and solvent removal were performed as in the Magnetic Carrier 14 Production Example using the resin-filled core particle, coating resin, and amount of coating given in Table 3. The completion of the coating operation was followed by transfer into a mixer (Drum Mixer Model UD-AT from Sugiyama Heavy Industrial Co., Ltd.) and heat treatment for 2 hours at a temperature of 200° C. under a nitrogen atmosphere. This was followed by magnetic separation and classification with a mesh having an aperture of 70 μm to obtain a magnetic carrier 23. The properties of the obtained magnetic carrier 23 are shown in Table 4.

TABLE 3

| | | | filling step | | | coating step | | | | | |
|---|---|---|---|---|---|---|---|---|---|---|---|
| magnetic carrier | resin-filled core particle | magnetic particle | filler resin | filler resin composition | filled amount [mass parts] | coating resin | coating resin composition | coating apparatus | first-stage amount of coating [mass parts] | second-stage amount of coating [mass parts] | third-stage amount of coating [mass parts] |
| carrier 1 | filled core 1 | magnetic particle 1 | filler resin 1 | silicone | 7.0 | coating resin 1 | CHMA/MMA | vacuum degassing kneader | 1.0 | 1.0 | |
| carrier 2 | filled core 2 | magnetic particle 2 | filler resin 1 | silicone | 7.0 | coating resin 1 | CHMA/MMA | vacuum degassing kneader | 1.0 | 1.0 | |
| carrier 3 | filled core 3 | magnetic particle 3 | filler resin 1 | silicone | 7.0 | coating resin 1 | CHMA/MMA | vacuum degassing kneader | 1.0 | 1.0 | |
| carrier 4 | filled core 4 | magnetic particle 4 | filler resin 1 | silicone | 6.5 | coating resin 1 | CHMA/MMA | vacuum degassing kneader | 1.0 | 1.0 | |
| carrier 5 | filled core 5 | magnetic particle 5 | filler resin 1 | silicone | 7.0 | coating resin 1 | CHMA/MMA | vacuum degassing kneader | 1.0 | 1.0 | |
| carrier 6 | filled core 4 | magnetic particle 4 | filler resin 1 | silicone | 6.5 | coating resin 1 | CHMA/MMA | fluidized bed | 2.0 | | |
| carrier 7 | filled core 6 | magnetic particle 6 | filler resin 1 | silicone | 7.0 | coating resin 1 | CHMA/MMA | vacuum degassing kneader | 1.5 | | |
| carrier 8 | filled core 7 | magnetic particle 7 | filler resin 1 | silicone | 7.0 | coating resin 1 | CHMA/MMA | fluidized bed | 2.0 | | |
| carrier 9 | filled core 8 | magnetic particle 8 | filler resin 1 | silicone | 7.0 | coating resin 1 | CHMA/MMA | vacuum degassing kneader | 1.0 | 0.5 | 0.5 |
| carrier 10 | filled core 9 | magnetic particle 9 | filler resin 1 | silicone | 7.0 | coating resin 1 | CHMA/MMA | fluidized bed | 2.5 | | |
| carrier 11 | filled core 10 | magnetic particle 10 | filler resin 1 | silicone | 7.0 | coating resin 1 | CHMA/MMA | vacuum degassing kneader | 2.0 | | |
| carrier 12 | filled core 11 | magnetic particle 11 | filler resin 1 | silicone | 7.0 | coating resin 1 | CHMA/MMA | fluidized bed | 2.5 | | |
| carrier 13 | filled core 12 | magnetic particle 12 | filler resin 1 | silicone | 7.0 | coating resin 1 | CHMA/MMA | vacuum degassing kneader | 1.0 | | |
| carrier 14 | filled core 13 | magnetic particle 13 | filler resin 1 | silicone | 7.0 | coating resin 1 | CHMA/MMA | Nauta | 1.0 | | |
| carrier 15 | filled core 14 | magnetic particle 14 | filler resin 1 | silicone | 7.0 | coating resin 1 | CHMA/MMA | Nauta | 1.0 | | |
| carrier 16 | filled core 15 | magnetic particle 15 | filler resin 1 | silicone | 7.0 | coating resin 1 | CHMA/MMA | Nauta | 1.0 | | |
| carrier 17 | filled core 16 | magnetic particle 16 | filler resin 1 | silicone | 7.0 | coating resin 1 | CHMA/MMA | Nauta | 1.0 | | |
| carrier 18 | filled core 17 | magnetic particle 17 | filler resin 1 | silicone | 7.0 | coating resin 2 | St/MMA | Nauta | 1.0 | | |
| carrier 19 | filled core 18 | magnetic particle 18 | filler resin 1 | silicone | 7.0 | coating resin 2 | St/MMA | Nauta | 1.0 | | |
| carrier 20 | filled core 19 | magnetic particle 19 | filler resin 1 | silicone | 7.0 | coating resin 2 | St/MMA | Nauta | 2.0 | | |
| carrier 21 | filled core 20 | magnetic particle 20 | filler resin 1 | silicone | 15.0 | coating resin 3 | silicone | Nauta | 0.5 | 0.5 | |
| carrier 22 | | magnetic particle 21 | | | | coating resin 2 | St/MMA | vacuum degassing kneader | 2.0 | | |
| carrier 23 | filled core 21 | magnetic particle 22 | filler resin 1 | silicone | 9.0 | coating resin 4 | silicone | Versatle Mixer | 1.0 | | |
| carrier 24 | filled core 22 | magnetic particle 23 | filler resin 1 | silicone | 7.0 | coating resin 1 | CHMA/MMA | Nauta | 1.0 | | |

TABLE 3-continued

| magnetic carrier | resin-filled core particle | magnetic particle | filling step: filler resin | filler resin composition | filled amount [mass parts] | coating step: coating resin | coating resin composition | coating apparatus | first-stage amount of coating [mass parts] | second-stage amount of coating [mass parts] | third-stage amount of coating [mass parts] |
|---|---|---|---|---|---|---|---|---|---|---|---|
| carrier 25 | filled core 23 | magnetic particle 24 | filler resin 1 | silicone | 7.0 | coating resin 1 | CHMA/MMA | Nauta | 1.0 | | |
| carrier 26 | filled core 24 | magnetic particle 25 | filler resin 1 | silicone | 6.0 | coating resin 1 | CHMA/MMA | Nauta | 1.0 | | |
| carrier 27 | filled core 25 | magnetic particle 26 | filler resin 1 | silicone | 7.0 | coating resin 1 | CHMA/MMA | Nauta | 1.5 | | |
| carrier 28 | filled core 26 | magnetic particle 27 | filler resin 1 | silicone | 7.0 | coating resin 1 | CHMA/MMA | Nauta | 1.0 | | |
| carrier 29 | filled core 27 | magnetic particle 28 | filler resin 1 | silicone | 7.0 | coating resin 1 | CHMA/MMA | Nauta | 1.0 | | |
| carrier 30 | filled core 28 | magnetic particle 29 | filler resin 1 | silicone | 7.0 | coating resin 1 | CHMA/MMA | Nauta | 1.0 | | |

TABLE 4

| magnetic carrier | particle diameter D50 (μm) | average percentage Av1 (area %) | area average value ($\mu m^2$) (*1) | average percentage Av2 (area %) | average percentage Av3 (area %) | residual magnetization ($Am^2/kg$) (*2) |
|---|---|---|---|---|---|---|
| carrier 1 | 40.1 | 2.8% | 1.05 | 2.1% | 85% | 1.0 |
| carrier 2 | 39.1 | 1.6% | 0.66 | 1.8% | 93% | 2.0 |
| carrier 3 | 39.9 | 2.5% | 1.16 | 2.8% | 89% | 1.0 |
| carrier 4 | 39.5 | 1.4% | 0.55 | 1.6% | 90% | 3.0 |
| carrier 5 | 40.6 | 3.0% | 1.24 | 4.5% | 83% | 1.0 |
| carrier 6 | 40.0 | 1.1% | 0.40 | 1.1% | 93% | 3.0 |
| carrier 7 | 43.5 | 3.1% | 1.48 | 5.5% | 84% | 1.0 |
| carrier 8 | 40.4 | 0.8% | 0.48 | 1.4% | 92% | 2.0 |
| carrier 9 | 39.3 | 3.8% | 1.20 | 3.8% | 90% | 1.0 |
| carrier 10 | 39.5 | 0.4% | 0.46 | 2.0% | 96% | 4.0 |
| carrier 11 | 39.8 | 4.6% | 1.35 | 8.5% | 81% | 1.0 |
| carrier 12 | 40.3 | 0.3% | 0.35 | 0.8% | 95% | 4.0 |
| carrier 13 | 39.5 | 4.8% | 0.80 | 5.5% | 79% | 3.0 |
| carrier 14 | 39.4 | 4.8% | 1.30 | 7.5% | 75% | 1.0 |
| carrier 15 | 38.9 | 4.0% | 0.44 | 5.5% | 85% | 5.0 |
| carrier 16 | 39.9 | 4.7% | 1.20 | 7.0% | 72% | 1.0 |
| carrier 17 | 40.0 | 4.0% | 0.49 | 5.5% | 85% | 4.0 |
| carrier 18 | 39.6 | 4.6% | 1.30 | 8.1% | 68% | 1.0 |
| carrier 19 | 39.6 | 4.2% | 0.55 | 6.5% | 78% | 4.0 |
| carrier 20 | 38.8 | 4.5% | 1.48 | 8.5% | 65% | 1.0 |
| carrier 21 | 40.1 | 3.8% | 1.10 | 2.0% | 83% | 1.0 |
| carrier 22 | 37.7 | | | | | 1.0 |
| carrier 23 | 37.4 | 0.6% | 0.46 | 2.0% | 96% | 5.0 |
| carrier 24 | 40.2 | 3.8% | 0.38 | 3.5% | 83% | 4.0 |
| carrier 25 | 38.8 | 4.5% | 1.30 | 5.5% | 75% | 2.0 |
| carrier 26 | 38.5 | 4.0% | 0.45 | 3.2% | 80% | 5.0 |
| carrier 27 | 40.1 | 4.5% | 1.45 | 6.3% | 77% | 1.0 |
| carrier 28 | 39.5 | 5.2% | 1.55 | 8.2% | 70% | 2.0 |
| carrier 29 | 38.4 | 5.5% | 1.48 | 8.5% | 68% | 3.0 |
| carrier 30 | 38.0 | 4.6% | 1.10 | 4.2% | 79% | 3.0 |

(*1) the average value provided by averaging the areas of the individual domains of the region originating with the porous ferrite core
(*2) the residual magnetization after the application of an external magnetic field of 1000/4π (kA/m)

<Toner Binder Resin Production Examples>

(Binder Resin 1)

1,2-propylene glycol 50.0 mass parts, terephthalic acid 45.0 mass parts, adipic acid 6.0 mass parts, and titanium tetrabutoxide 0.3 mass parts were introduced into a glass 4-L four-neck flask, which was fitted with a thermometer, stirring rod, condenser, and nitrogen inlet tube and placed in a heating mantle. The interior of the flask was then substituted by nitrogen; the temperature was subsequently gradually raised while stirring; and a reaction was carried out for 2 hours while stirring at a temperature of 200° C. 6.5 mass parts of trimellitic acid and 0.2 mass parts of titanium tetrabutoxide were then additionally added and a reaction was run for 2 hours while stirring at 190° C. to obtain a binder resin 1.

Binder resin 1 had a glass-transition temperature (Tg) of 61.4° C., a peak molecular weight (Mp) of 17000, a number-average molecular weight (Mn) of 6000, and a weight-average molecular weight (Mw) of 86000.

(Binder Resin 2)

70.0 mass parts of polyoxypropylene(2.2)-2,2-bis(4-hydroxyphenyl)propane, 23.0 mass parts of terephthalic acid, 7.0 mass parts of trimellitic anhydride, and 1.0 mass part of titanium tetrabutoxide were introduced into a glass 4-L four-neck flask, which was fitted with a thermometer, stirring rod, condenser, and nitrogen inlet tube and placed in a heating mantle. The interior of the flask was then substituted by nitrogen gas; the temperature was subsequently gradually raised while stirring; and a reaction was carried out for 10 hours while stirring at a temperature of 200° C. to obtain a binder resin 2. Binder resin 2 had a glass-transition temperature (Tg) of 56.0° C., a peak molecular weight (Mp) of 8100, and a number-average molecular weight (Mn) of 4900.

<Inorganic Fine Particle (Sol-Gel Silica Fine Particles) Production Method>

700 g of methanol, 45 g of water, and 55 g of 28 mass % aqueous ammonia were introduced into a reactor and were mixed at 35° C. 1300 g of tetramethoxysilane and 460 g of 5.4 mass % aqueous ammonia were added over 6 hours and a hydrolysis was run to obtain a methanol-water dispersion of sol-gel silica fine particles. 550 g of hexamethyldisilazane was added at room temperature to this methanol-water dispersion and a reaction was run for 3 hours with heating to 60° C. to perform a hydrophobic treatment of the silica fine particle surface. The coarse particles were removed by passage through a sieve by a wet method followed by removal of the solvent and drying to obtain 520 g of inorganic fine particle A1 (sol-gel silica fine particles).

The number-average primary particle diameter of the obtained inorganic fine particle A1 was 110 nm. Inorganic fine particles (sol-gel silica fine particles) A2 to A5 having number-average primary particle diameters of 55 nm, 70 nm, 280 nm, and 310 nm were similarly prepared by appropriate changes in the reaction temperature and stirring rate.

TABLE 5

| | inorganic fine particle | number-average primary particle diameter (nm) | material |
|---|---|---|---|
| inorganic fine particle A | inorganic fine particle A1 | 110 | sol-gel silica |
| | inorganic fine particle A2 | 70 | sol-gel silica |
| | inorganic fine particle A3 | 280 | sol-gel silica |
| | inorganic fine particle A4 | 310 | sol-gel silica |
| | inorganic fine particle A5 | 55 | sol-gel silica |

<Toner 1 Production Example>

| | |
|---|---|
| binder resin 1 | 40.0 mass parts |
| binder resin 2 | 60.0 mass parts |
| purified normal-paraffin wax (peak temperature of the maximum endothermic peak = 70° C.) | 5.0 mass parts |
| C.I. Pigment Blue 15:3 | 5.0 mass parts |
| aluminum compound of 3,5-di-t-butylsalicylic acid | 0.3 mass parts |

These materials were thoroughly mixed with a HENSCHEL Mixer (model FM-75 from Mitsui Mining Co., Ltd.) and were then melt kneaded with a twin-screw kneader (model PCM-30 from the Ikegai Corporation) set at a temperature of 120° C. The obtained kneaded material was cooled and coarsely pulverized with a hammer mill to 1 mm and below to obtain a coarsely pulverized material.

The obtained coarsely pulverized material was then converted into a 5.5 μm finely pulverized material using a Turbo Mill (T-250: RSS rotor/SNB liner) from Turbo Kogyo Co., Ltd.

The obtained finely pulverized material was classified using a particle design device from the Hosokawa Micron Corporation having an improved hammer shape and number (product name: Faculty) to obtain a toner particle 1 having an average circularity of 0.944.

1.0 mass part of hydrophobic silica fine particles that had a BET specific surface area of 115 $m^2/g$ and that had been surface-treated with 20 mass % hexamethyldisilazane, 1.0 mass part of a rutile titanium oxide that had a BET specific surface area of 70 $m^2/g$ and that had been surface-treated with 20 mass % triethoxyoctylsilane, and 10.0 mass parts of inorganic fine particle A1 were added to 100 mass parts of toner particle 1 and mixing was performed with a HENSCHEL mixer (Model FM-75 from Mitsui Miike Chemical Engineering Machinery Co., Ltd.) at a rotation rate of 30 $s^{-1}$ and a rotation time of 2 minutes to obtain a toner 1. The external addition formulation, particle diameter, and coverage ratio for toner 1 are given in Table 6.

<Toners 2 to 7 Production Example>

Toners 2 to 7 were obtained proceeding as for toner 1, but carrying out the external addition mixing using different selections and amounts of addition of inorganic fine particle A to toner particle 1 as shown in Table 6. The external additive coverage ratio is shown in Table 6.

TABLE 6

| | toner | | | coverage ratio by | inorganic fine particle A | | | silica (BET115) | titanium oxide (BET70) |
|---|---|---|---|---|---|---|---|---|---|
| | toner particle | particle diameter (μm) | average circularity | inorganic fine particle A (%) | number-average primary particle diameter (nm) | | number of parts of addition | number of parts of addition | number of parts of addition |
| toner 1 | toner particle 1 | 5.5 | 0.944 | 75 | A1 | 110 | 4.0 mass parts | 1.0 mass part | 1.0 mass part |
| toner 2 | ↑ | ↑ | ↑ | 65 | A1 | ↑ | 2.5 mass parts | 1.0 mass part | 1.0 mass part |
| toner 3 | ↑ | ↑ | ↑ | 64 | A2 | 70 | 1.5 mass parts | 1.0 mass part | 1.0 mass part |
| toner 4 | ↑ | ↑ | ↑ | 64 | A3 | 280 | 6.0 mass parts | 1.0 mass part | 1.0 mass part |
| toner 5 | ↑ | ↑ | ↑ | 55 | A1 | 110 | 1.0 mass part | 1.0 mass part | 1.0 mass part |
| toner 6 | ↑ | ↑ | ↑ | 53 | A4 | 310 | 2.0 mass parts | 1.0 mass part | 1.0 mass part |
| toner 7 | ↑ | ↑ | ↑ | 55 | A5 | 55 | 0.5 mass parts | 1.0 mass part | 1.0 mass part |

Example 1

A two-component developer was prepared by adding 10 mass part of toner 1 to 90 mass parts of magnetic carrier 1 and mixing for 10 minutes in a V-mixer.

[Evaluation of the Two-Component Developers]

Evaluations were performed by producing images using a modified version of an imageRUNNER ADVANCE C5051, a digital printer for commercial applications from Canon, Inc., as the image-forming apparatus. The evaluations described below were carried out with the previously described two-component developers placed in the cyan developing device of the image-forming apparatus.

The modifications consisted of the detachment of the mechanism that discharges magnetic carrier present in excess within the developing device from the developing device and the application of a direct-current voltage $V_{DC}$ and an alternating-current voltage having a frequency of 8.0 kHz and a peak-to-peak voltage (Vpp) of 0.5 kV to the developer bearing member.

In order to provide a toner laid-on amount on the paper for the FFh image (solid image) of 0.45 mg/cm$^2$, the difference (Vback) between Vdc and Vl (light region potential) was fixed at 100 V and adjustments were made by raising or lowering Vd (dark region potential) in order to change Vcont (Vd−Vdc). FFh is the hexadecimal representation of 256 gradations, where 00h is the 1st gradation (white background) of the 256 gradations and FFh is the 256th gradation (solid region) of the 256 gradations.

For image output durability testing, 50000 prints were continuously output at an image ratio of 40% in a high-temperature, high-humidity atmosphere (temperature 30° C./humidity 80% RH ("H/H" below)).

CS-814 Laserprinter Paper (81.4 g/m$^2$) (sold by Canon Marketing Japan Inc.) was used for the evaluations. Before and after the image output durability test, the appropriate adjustment was made to bring the amount of toner laid on the paper to that described above and the items described in the following were evaluated.

<Charging Characteristics (Charging Stability Durability)>

The developer was sampled from the developing device before and after the 50000-print image output durability testing in a high-temperature, high-humidity environment and the quantity of charge was measured. The triboelectric charge quantity (mC/kg) was measured using a Separ-soft Model STC-1-C1 (Sankyo Pio-Tech Co., Ltd.) suction separation-type device for measuring charge quantity, which was placed in a high-temperature, high-humidity environment. A mesh (wire net) having an aperture of 20 μm is placed at the bottom of the sample holder (Faraday cage); 0.10 g of the sampled developer is introduced on top of this; and the lid is closed. The mass of the entire sample holder at this point is weighed and designated W1 (g). The sample holder is then placed in the main instrument and the air quantity control valve is adjusted to provide a suction pressure of 2 kPa. Suction removal of the toner is performed in this state by suctioning for 2 minutes. The current at this time is designated as Q (μC). The mass of the entire sample holder after suctioning is also weighed and designated W2 (g). Since the charge of the carrier is being measured, the triboelectric charge quantity for the toner has the opposite polarity from the Q determined at this time. The absolute value of the triboelectric charge quantity (mC/kg) of this developer is calculated using the following formula.

$$\text{triboelectric charge quantity(mC/kg)}=Q/(W1-W2)$$

The following evaluation criteria were used for the evaluation criteria for the difference in the charge quantity (amount of decline).

A: the difference between the initial charge quantity and the charge quantity after 50000 prints is less than 5 (very good)

B: the difference between the initial charge quantity and the charge quantity after 50000 prints is at least 5 but less than 10 (good)

C: the difference between the initial charge quantity and the charge quantity after 50000 prints is at least 10 but less than 15 (acceptable level in the present invention)

D: the difference between the initial charge quantity and the charge quantity after 50000 prints is at least 15 (impractical level in the present invention)

<Evaluation of the Charge Rising Behavior>

9.2 g of magnetic carrier 1 is weighed into a 50-mL polyethylene bin (referred to simply as the bin in the following). 0.8 g of toner 1 is weighed onto this, and, in the state in which the magnetic carrier and toner are layered, a humidity adjustment is performed for 24 hours in a normal-temperature, normal-humidity environment (temperature of 23° C., humidity of 60% RH). After the humidity adjustment, the lid on the bin was closed and it was rotated 15 times in a roll mill at a rate of 1 rotation per second. The bin with the sample was then installed in a shaker and the toner and magnetic carrier were mixed, by shaking at 150 strokes per minute, for 15 seconds or in the same way for 120 seconds to produce respective developers for submission to measurement.

A Separ-soft Model STC-1-C1 (Sankyo Pio-Tech Co., Ltd.) suction separation-type device for measuring charge quantity was used as the device for measuring the triboelectric charge quantity. A mesh (wire net) having an aperture of 20 μm is placed at the bottom of the sample holder (Faraday cage); 0.10 g of the developer is introduced on top of this; and the lid is closed. The mass of the entire sample holder at this point is weighed and designated W1 (g). The sample holder is then placed in the main instrument and the air quantity control valve is adjusted to provide a suction pressure of 2 kPa. Suction removal of the toner is performed in this state by suctioning for 2 minutes. The current at this time is designated as Q (μC). The mass of the entire sample holder after suctioning is weighed and designated W2 (g). Since the charge of the carrier is being measured, the triboelectric charge quantity for the toner has the opposite polarity from the Q determined at this time. The absolute value of the triboelectric charge quantity (mC/kg) of this developer is calculated using the following formula. This measurement was also performed in a normal-temperature, normal-humidity environment (temperature of 23° C., humidity of 60% RH).

$$\text{triboelectric charge quantity(mC/kg)}=Q/(W1-W2)$$

Designating the charge quantity after mixing for 15 seconds as the "15-second rise-up of charging" and the charge quantity after mixing for 120 seconds as the "120-second rise-up of charging", their difference is defined as the "A charge quantity" and this A charge quantity was evaluated as the charge rising performance of the developer.

(Evaluation Criteria)

A: less than 6.0 mC/kg (very good)

B: at least 6.0 mC/kg but less than 8.0 mC/kg (good)

C: at least 8.0 mC/kg but less than 12.0 mC/kg (acceptable at a practical level in the present invention)

D: at least 12.0 mC/kg (impractical level in the present invention)

<Scratching of the Electrostatic Latent Image Bearing Member (Evaluation Related to Carrier Strength)>

In the event of a low carrier strength, fracture occurs in the transfer and cleaning sections and gouging then occurs into the electrostatic latent image bearing member. The gouged-in fragments become starting points and stripes of toner melt adhesion (scratching of the electrostatic latent image bearing member) are produced in the direction of rotation of the electrostatic latent image bearing member and stripes are seen in the image as a result. Accordingly, the fact that there is a correlation between carrier strength and the size of the scratching (height=roughness) of the electrostatic latent image bearing member is used as a method for indirectly evaluating carrier strength.

Specifically, the surface roughness of the electrostatic latent image bearing member was evaluated after the aforementioned 50000-print image output durability testing. The $R_p$ (maximum peak height) specified in JIS B 0601:2001 was used as the index of the surface roughness. A surface roughness analyzer (SURFCOM 1500SD from Tokyo Seimitsu Co., Ltd.) was used for the measurement, and the measurement was carried out by scanning in the axial direction using a measurement length of 8 mm, a speed of 0.5 mm/sec, a cut-off $\lambda_C$ of 0.8 mm, and the JIS 2001 parameter calculation standard. The measurement was carried out at a total of 80 points for 8 points in the circumferential direction and 10 points in the length direction, and the average value was taken to be the Rp of the electrostatic latent image bearing member and was evaluated according to the following criteria.

A: less than 0.3 μm (very good)

B: at least 0.3 μm but less than 0.6 μm (good)

C: at least 0.6 μm but less than 1.0 μm (acceptable at a practical level in the present invention)

D: at least 1.0 μm (unacceptable in the present invention)

<Fogging>

One A4 print is made of a solid white image (Vback set to 150 V).

The average reflectance Dr (%) of the paper was measured using a reflectometer ("REFLECTOMETER MODEL TC-6DS" from Tokyo Denshoku Co., Ltd.).

The reflectance Ds (%) of the solid white image was measured. The fogging (%) was calculated using the formula given below. The obtained fogging was evaluated using the evaluation criteria given below. After the evaluation following the 50000-print image output durability testing in a high-temperature, high-humidity environment, the machine was unplugged from the power socket and allowed to stand for 168 hours in a high-temperature, high-humidity environment and the same fogging test as above was then performed.

$$\text{fogging}(\%)=Dr(\%)-Ds(\%)$$

A: less than 0.5% (very good)

B: at least 0.5 but less than 1.0% (good)

C: at least 1.0 but less than 2.0% (acceptable at a practical level in the present invention)

D: at least 2.0% (impractical level in the present invention)

<Leakage Test>

After the image output durability testing, and using developer that had finished the evaluation, the toner was blown off to reduce the toner concentration to 5% and an evaluation of leakage was performed. The evaluation was performed by raising the development Vpp to 1.0 kV and using the following method.

Five prints of a solid (FFh) image are continuously output on an ordinary A4 paper; the number of exposed white points having a diameter of at least 1 mm in the image is counted; and the evaluation is performed based on their total count on the 5 prints.

The following evaluation criteria were used for the evaluation criteria for the leakage.

A: at least 0 but fewer than 5 (very good)

B: at least 5 but fewer than 10 (good)

C: at least 10 but fewer than 20 (acceptable at a practical level in the present invention)

D: at least 20 (impractical level in the present invention)

<Test of the Change in the Fixing Gloss>

A two-component developer was prepared by adding 10 mass parts of toner 1 to 90 mass parts of magnetic carrier 1 and mixing for 10 minutes with a V-mixer.

An imageRUNNER ADVANCE C9075 PRO, a digital color printer for commercial service from Canon, Inc., was used as the image-forming apparatus; it was modified so the sleeve peripheral velocity of the developing device in the main unit could be freely varied and to enable idle rotation. The two-component developer, after humidity adjustment for 12 hours in a normal-temperature, normal-humidity environment (temperature of 23° C./humidity of 60% RH ("N/N" in the following)), was introduced into the developing device and idle rotation was carried out for a total of 10 hours at a sleeve peripheral velocity of 500 mm/second. For the evaluation, NS1000 (209 gsm) A3 paper was used; the Vcont potential was adjusted to provide a toner laid-on level on the paper of 0.45 mg/cm$^2$; and a solid image was output over the entire surface and the gloss value was measured. The gloss value of the solid image was taken to be the gloss (gloss value) provided by taking the average value for a total of 15 locations: 5 locations in the A3 longitudinal (length) direction (both edges, the center, and the midpoints between the center and the edges) and 3 locations in the width direction. In the test of the change in the fixing gloss (gloss value), the gloss value was measured before and after the idle rotation test and an evaluation was performed based on the difference in these gloss values.

The following evaluation criteria were used for the evaluation criteria in the test of the change in the gloss value (gloss).

A: the difference in the gloss value pre-versus-post-idle rotation testing is less than 3 (very good)

B: the difference in the gloss value pre-versus-post-idle rotation testing is at least 3 but less than 5 (good)

C: the difference in the gloss value pre-versus-post-idle rotation testing is at least 5 but less than 10 (acceptable at a practical level in the present invention)

D: the difference in the gloss value pre-versus-post-idle rotation testing is at least 10 (impractical level in the present invention)

Examples 2 to 26 and Comparative Examples 1 to 10

Two-component developers were prepared as in Example 1 using the toner+magnetic carrier combinations shown in Table 7 and were submitted to the evaluations. The same items as in Example 1 were evaluated, and the results of the evaluations are given in Table 8.

TABLE 7

| Examples | magnetic carrier | toner |
|---|---|---|
| Example 1 | carrier 1 | toner 1 |
| Example 2 | carrier 2 | toner 1 |
| Example 3 | carrier 3 | toner 1 |

TABLE 7-continued

| Examples | magnetic carrier | toner |
|---|---|---|
| Example 4 | carrier 4 | toner 1 |
| Example 5 | carrier 5 | toner 1 |
| Example 6 | carrier 5 | toner 2 |
| Example 7 | carrier 5 | toner 3 |
| Example 8 | carrier 5 | toner 4 |
| Example 9 | carrier 5 | toner 5 |
| Example 10 | carrier 5 | toner 6 |
| Example 11 | carrier 5 | toner 7 |
| Example 12 | carrier 6 | toner 1 |
| Example 13 | carrier 7 | toner 1 |
| Example 14 | carrier 8 | toner 1 |
| Example 15 | carrier 9 | toner 1 |
| Example 16 | carrier 10 | toner 1 |
| Example 17 | carrier 11 | toner 1 |
| Example 18 | carrier 12 | toner 1 |
| Example 19 | carrier 13 | toner 1 |
| Example 20 | carrier 14 | toner 1 |

TABLE 7-continued

| Examples | magnetic carrier | toner |
|---|---|---|
| Example 21 | carrier 15 | toner 1 |
| Example 22 | carrier 16 | toner 1 |
| Example 23 | carrier 17 | toner 1 |
| Example 24 | carrier 18 | toner 1 |
| Example 25 | carrier 19 | toner 1 |
| Example 26 | carrier 20 | toner 1 |
| Comparative Example 1 | carrier 21 | toner 1 |
| Comparative Example 2 | carrier 22 | toner 1 |
| Comparative Example 3 | carrier 23 | toner 1 |
| Comparative Example 4 | carrier 24 | toner 2 |
| Comparative Example 5 | carrier 25 | toner 3 |
| Comparative Example 6 | carrier 26 | toner 4 |
| Comparative Example 7 | carrier 27 | toner 5 |
| Comparative Example 8 | carrier 28 | toner 6 |
| Comparative Example 9 | carrier 29 | toner 7 |
| Comparative Example 10 | carrier 30 | toner 7 |

TABLE 8

| | | | charging stability durability | | | | | | | | | | | | | | | |
|---|---|---|---|---|---|---|---|---|---|---|---|---|---|---|---|---|---|---|
| Examples | magnetic carrier | toner | initial quantity of charge | quantity of charge after durability testing | in the quantity of charge (amount of decline) | | leakage test | | fogging | | 15-second charge rise | 120-second charge rise | Δ charge quantity | | change in fixing gloss | | carrier strength | |
| Example 1 | carrier 1 | toner 1 | 35 | 35 | 0 | A | 0 | A | 0.2 | A | 49 | 50 | 1 | A | 0 | A | 0.1 | A |
| Example 2 | carrier 2 | toner 1 | 34 | 33 | 1 | A | 0 | A | 0.3 | A | 49 | 50 | 1 | A | 0 | A | 0.1 | A |
| Example 3 | carrier 3 | toner 1 | 36 | 34 | 2 | A | 0 | A | 0.2 | A | 49 | 51 | 2 | A | 0 | A | 0.3 | B |
| Example 4 | carrier 4 | toner 1 | 34 | 34 | 0 | A | 0 | A | 0.3 | A | 44 | 50 | 6 | B | 1 | A | 0.1 | A |
| Example 5 | carrier 5 | toner 1 | 36 | 34 | 2 | A | 0 | A | 0.2 | A | 48 | 50 | 2 | A | 0 | A | 0.3 | B |
| Example 6 | carrier 5 | toner 2 | 35 | 33 | 2 | A | 0 | A | 0.2 | A | 48 | 51 | 3 | A | — | — | — | — |
| Example 7 | carrier 5 | toner 3 | 37 | 33 | 4 | A | 0 | A | 0.2 | A | 50 | 54 | 4 | A | — | — | — | — |
| Example 8 | carrier 5 | toner 4 | 35 | 32 | 3 | A | 0 | A | 0.2 | A | 46 | 49 | 3 | A | — | — | — | — |
| Example 9 | carrier 5 | toner 5 | 36 | 31 | 5 | B | 0 | A | 0.3 | A | 48 | 53 | 5 | A | — | — | — | — |
| Example 10 | carrier 5 | toner 6 | 35 | 29 | 6 | B | 0 | A | 0.4 | A | 45 | 50 | 5 | A | — | — | — | — |
| Example 11 | carrier 5 | toner 7 | 37 | 30 | 7 | B | 0 | A | 0.4 | A | 50 | 57 | 7 | B | — | — | — | — |
| Example 12 | carrier 6 | toner 1 | 34 | 31 | 3 | A | 0 | A | 0.3 | A | 44 | 51 | 7 | B | 0 | A | 0.1 | A |
| Example 13 | carrier 7 | toner 1 | 37 | 35 | 2 | A | 2 | A | 0.2 | A | 47 | 48 | 1 | A | 1 | A | 0.4 | B |
| Example 14 | carrier 8 | toner 1 | 35 | 31 | 4 | A | 1 | A | 0.4 | A | 42 | 45 | 3 | A | 0 | A | 0.2 | A |
| Example 15 | carrier 9 | toner 1 | 38 | 34 | 4 | A | 6 | B | 0.3 | A | 48 | 50 | 2 | A | 1 | A | 0.5 | B |
| Example 16 | carrier 10 | toner 1 | 35 | 32 | 3 | A | 1 | A | 0.4 | A | 44 | 52 | 8 | C | 1 | A | 0.2 | A |
| Example 17 | carrier 11 | toner 1 | 35 | 31 | 4 | A | 9 | B | 0.4 | A | 51 | 50 | −1 | A | 2 | A | 0.6 | C |
| Example 18 | carrier 12 | toner 1 | 31 | 28 | 3 | A | 2 | A | 0.5 | B | 46 | 55 | 9 | C | 1 | A | 0.2 | A |
| Example 19 | carrier 13 | toner 1 | 31 | 27 | 4 | A | 16 | C | 0.5 | B | 39 | 45 | 6 | B | 2 | A | 0.7 | C |
| Example 20 | carrier 14 | toner 1 | 32 | 26 | 6 | B | 14 | C | 0.6 | B | 42 | 44 | 2 | A | 5 | C | 0.6 | C |
| Example 21 | carrier 15 | toner 1 | 30 | 24 | 6 | B | 11 | C | 0.7 | B | 35 | 46 | 11 | C | 3 | B | 0.2 | A |
| Example 22 | carrier 16 | toner 1 | 31 | 24 | 7 | B | 15 | C | 0.8 | B | 40 | 45 | 5 | A | 4 | B | 0.7 | C |
| Example 23 | carrier 17 | toner 1 | 30 | 19 | 11 | C | 17 | C | 1.1 | C | 37 | 45 | 8 | C | 3 | B | 0.2 | A |
| Example 24 | carrier 18 | toner 1 | 37 | 24 | 13 | C | 8 | B | 1.0 | C | 42 | 47 | 5 | A | 8 | C | 0.8 | C |
| Example 25 | carrier 19 | toner 1 | 28 | 15 | 13 | C | 18 | C | 1.4 | C | 33 | 42 | 9 | C | 7 | C | 0.2 | A |
| Example 26 | carrier 20 | toner 1 | 40 | 26 | 14 | C | 5 | B | 1.3 | C | 44 | 49 | 5 | A | 9 | C | 0.9 | C |
| Comparative Example 1 | carrier 21 | toner 1 | 45 | 28 | 17 | D | 2 | A | 2.1 | D | 56 | 60 | 4 | A | 16 | D | 1.1 | D |
| Comparative Example 2 | carrier 22 | toner 1 | 30 | 14 | 16 | D | 2 | A | 2.5 | D | 50 | 55 | 5 | A | 9 | C | 0.2 | A |
| Comparative Example 3 | carrier 23 | toner 1 | 40 | 22 | 18 | D | 2 | A | 1.6 | C | 45 | 58 | 13 | D | 18 | D | 1.2 | D |
| Comparative Example 4 | carrier 24 | toner 2 | 30 | 19 | 11 | C | 25 | D | 2.1 | D | 33 | 45 | 12 | D | 6 | C | 0.5 | B |
| Comparative Example 5 | carrier 25 | toner 3 | 40 | 25 | 15 | D | 1 | A | 1.8 | C | 51 | 55 | 4 | A | 7 | C | 0.5 | B |
| Comparative Example 6 | carrier 26 | toner 4 | 28 | 14 | 14 | C | 2 | A | 2.4 | D | 30 | 45 | 15 | D | 6 | C | 0.2 | A |
| Comparative Example 7 | carrier 27 | toner 5 | 32 | 15 | 17 | D | 3 | A | 2.0 | D | 41 | 45 | 4 | A | 6 | C | 0.5 | B |
| Comparative Example 8 | carrier 28 | toner 6 | 31 | 13 | 18 | D | 4 | A | 2.5 | D | 42 | 46 | 4 | A | 5 | C | 0.5 | B |
| Comparative Example 9 | carrier 29 | toner 7 | 31 | 16 | 15 | D | 22 | D | 1.9 | C | 38 | 48 | 10 | C | 8 | C | 0.2 | A |
| Comparative Example 10 | carrier 30 | toner 7 | 31 | 15 | 16 | D | 1 | A | 1.8 | C | 36 | 44 | 8 | C | 5 | C | 1.3 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-121362, filed on May 28, 2012, which is hereby incorporated by reference herein in its entirety.

1 cylindrical PTFE resin container
2 lower electrode (stainless steel)
3 support base (PTFE resin)
4 upper electrode (stainless steel)
5 sample (magnetic carrier or porous ferrite particle)
6 electrometer
7 control computer
8 toner particle
9 autofeeder
10 feed nozzle
11 surface modification apparatus
12 hot air current introduction port
13 cold air current introduction port
14 surface-modified toner particle
15 cyclone
16 blower

What is claimed is:

1. A magnetic carrier of which a resin-filled core is coated with a vinyl-resin, the resin-filled core having a porous ferrite particle in pores of which a resin is filled, wherein the porous ferrite particle i) has a resistivity at 100 V/cm of from at least $8.0\times10^4$ Ω·cm to not more than $5.0\times10^6$ Ω·cm, ii) contains an oxide of Mg in the range from at least 1.00 mass % to not more than 15.00 mass % as MgO with reference to the mass of the porous ferrite particle, and iii) contains an oxide of Sr and an oxide of Ca, with a total content of these oxides of from at least 0.20 mass % to not more than 3.00 mass % as SrO and CaO with reference to the mass of the porous ferrite particle, and wherein in a backscattered electron projection image of the magnetic carrier obtained by using a scanning electron microscope at an acceleration voltage of 2.0 kV, the magnetic carrier has a total area for regions originating from the porous ferrite particle of from at least 0.2 area % to not more than 5.0 area % with reference to the projected area of the magnetic carrier.

2. The magnetic carrier according to claim 1, wherein, with respect to the regions originating from the porous ferrite particle in the projection image, the magnetic carrier has an average value worked out by averaging the area of each of regions that originates from the porous ferrite particle of from at least 0.45 $\mu m^2$ to not more than 1.40 $\mu m^2$.

3. The magnetic carrier according to claim 1, wherein, with respect to the regions originating with the porous ferrite particle in the projection image, the magnetic carrier has i) a total area for the regions, in which the area of each of regions is at least 6.672 $\mu m^2$, accounts for not more than 8.0 area % with reference to the total area of the regions originating with the porous ferrite particle, and ii) a total area for the regions, in which the area of each of regions is not more than 2.780 $\mu m^2$, accounts for at least 70.0 area % with reference to the total area of the regions originating with the porous ferrite particle.

4. The magnetic carrier according to claim 1, wherein the magnetic carrier has a residual magnetization, after the application of an external magnetic field of 1000/4π (kA/m), of not more than 3.0 $Am^2/kg$.

5. The magnetic carrier according to claim 1, wherein the amount of resin filled in the pores of the porous ferrite particle is from at least 6 mass % to not more than 25 mass % with reference to the porous ferrite particle.

6. The magnetic carrier according to claim 1, wherein the amount of vinyl resin coating the resin-filled core is from at least 0.1 mass parts to not more than 5.0 mass parts for each 100 mass parts of the resin-filled core.

7. The magnetic carrier according to claim 1, wherein the magnetic carrier has a true specific gravity of from at least 3.5 $g/cm^3$ to not more than 4.2 $g/cm^3$.

8. The magnetic carrier according to claim 1, wherein the magnetic carrier has an intensity of magnetization at 1000/4π (kA/m) of from at least 40 $Am^2/kg$ to not more than 65 $Am^2/kg$ and a residual magnetization, after the application of an external magnetic field of 1000/4π (kA/m), of not more than 3.0 $Am^2/kg$.

9. A two-component developer comprising a magnetic carrier and a toner having a toner particle that comprises a binder resin and a colorant, wherein the magnetic carrier is the magnetic carrier according to claim 1.

10. The two-component developer according to claim 9, wherein the toner comprises the toner particles and inorganic fine particles each having a number-average primary particle diameter of from at least 60 nm to not more than 300 nm, and the coverage ratio of the toner particles by the inorganic fine particles is at least 60%.

* * * * *